US011015366B2

(12) United States Patent
Wilhelm

(10) Patent No.: US 11,015,366 B2
(45) Date of Patent: May 25, 2021

(54) STACKABLE REINFORCED CONCRETE POST FOR VARIOUS OUTDOOR APPLICATIONS

(71) Applicant: Stanley Ray Wilhelm, Urbandale, IA (US)

(72) Inventor: Stanley Ray Wilhelm, Urbandale, IA (US)

( * ) Notice: Subject to any disclaimer, the term of this patent is extended or adjusted under 35 U.S.C. 154(b) by 0 days.

(21) Appl. No.: 16/678,782

(22) Filed: Nov. 8, 2019

(65) Prior Publication Data

US 2020/0071951 A1 Mar. 5, 2020

Related U.S. Application Data

(63) Continuation-in-part of application No. 15/648,641, filed on Jul. 13, 2017, now abandoned.

(51) Int. Cl.

| | |
|---|---|
| ***E04H 17/22*** | (2006.01) |
| ***E04H 17/12*** | (2006.01) |
| ***E04H 17/06*** | (2006.01) |
| ***E04H 17/14*** | (2006.01) |

(52) U.S. Cl.

CPC ..... *E04H 17/22* (2013.01); *E04H 17/06* (2013.01); *E04H 17/12* (2013.01); *E04H 17/146* (2021.01)

(58) Field of Classification Search

CPC ..... E04H 17/06; E04H 17/12; E04H 17/1404; E04H 17/1426; E04H 17/161; E04H 17/20; E04H 17/22; E04H 2017/146

USPC ..... 256/1, 19, 32, 65.02, 65.14

See application file for complete search history.

(56) References Cited

U.S. PATENT DOCUMENTS

| | | | | |
|---|---|---|---|---|
| 1,045,292 | A | 11/1912 | Huntington | |
| 2,387,659 | A * | 10/1945 | Hafsos | E04B 2/705 52/223.7 |
| 3,209,510 | A * | 10/1965 | Nakanishi | E04B 2/56 52/745.17 |
| 4,519,586 | A | 5/1985 | Wilhelm | |
| 5,934,035 | A | 8/1999 | Rasmussen | |
| 6,185,888 | B1 | 2/2001 | Wasson | |
| 6,224,295 | B1 * | 5/2001 | Price | E02D 29/025 405/262 |
| 6,513,296 | B1 | 2/2003 | Baden | |
| 6,758,020 | B2 | 7/2004 | Cerrato | |
| 7,302,778 | B2 | 12/2007 | MacMillan | |
| 7,373,753 | B1 | 5/2008 | Caruso | |
| 7,454,870 | B2 | 11/2008 | Greenberg | |
| 7,641,178 | B2 | 1/2010 | MacDonald | |
| 7,934,345 | B2 | 5/2011 | Marsh | |
| 8,839,593 | B2 | 9/2014 | Barrett | |
| 10,006,220 | B2 * | 6/2018 | Lee | E04H 17/22 |
| 10,105,890 | B2 * | 10/2018 | Kelly | E04H 17/1404 |
| 10,316,539 | B2 * | 6/2019 | Lupton | E04H 17/161 |
| 10,519,658 | B1 * | 12/2019 | Herron, III | E04C 3/32 |

(Continued)

OTHER PUBLICATIONS

"Caulking Concrete Cracks." The Family Handyman. Oct. 29, 2015, [online], [retrieved on Dec. 5, 2020] Retrieved from the Internet < URL: https://web.archive.org/web/20151029183845/http://www.familyhandyman.com/masonry/concrete-repair/caulking-concrete-cracks/print>.*

*Primary Examiner* — Josh Skroupa
(74) *Attorney, Agent, or Firm* — Daniel M. Northfield

(57) ABSTRACT

A Stackable Reinforced Concrete Post for Various Outdoor Applications includes a concrete pylon base and multiple concrete modules that are stacked vertically.

2 Claims, 27 Drawing Sheets

(56) References Cited

U.S. PATENT DOCUMENTS

| | | | |
|---|---|---|---|
| 2006/0175591 | A1 | 8/2006 | Caesar |
| 2009/0120023 | A1 | 5/2009 | Hoggan |

* cited by examiner

STACKABLE REINFORCED CONCRETE POST FOR VARIOUS OUTDOOR APPLICATIONS

This invention claims priority to application Ser. No. 15/648,641 filed Jul. 13, 2017, and is a continuation in part of that application.

BACKGROUND OF THE INVENTION

The invention pertains to concrete post design and construction that can be used with other fencing materials. This invention has comparable or potentially a longer life span than the traditional wooden post. Also, it should be an excellent replacement to the traditional wooden post, as timber is getting scarce. The stackable concrete post can potentially be installed with less man power since the post is made up of modular elements. The applications of this invention include standard privacy fencing, and barbed and woven wire fencing.

BRIEF SUMMARY OF THE INVENTION

The stackable reinforced concrete post consists of a concrete pylon base and multiple concrete modules, that are stacked vertically to form a post that can be used to erect fencing. The concrete pylon base and concrete module are reinforced using a galvanized wire cage within the concrete. The pylon base and modules have specifically designed holes where the rebar is inserted. Epoxy and/or anchoring cement is used to fill in the space in the holes with the rebar inserted into for permanently anchoring the rebar. Mortar or waterproof silicone is applied between the stacking of the units to prevent any possible damage to the joint due to freezing precipitation.

BRIEF DESCRIPTION OF DRAWINGS

FIG. 13 shows a posterior view of the module of FIG. 12, showing a notch where the wire or barbed wire fencing lays in.

Figure 16:
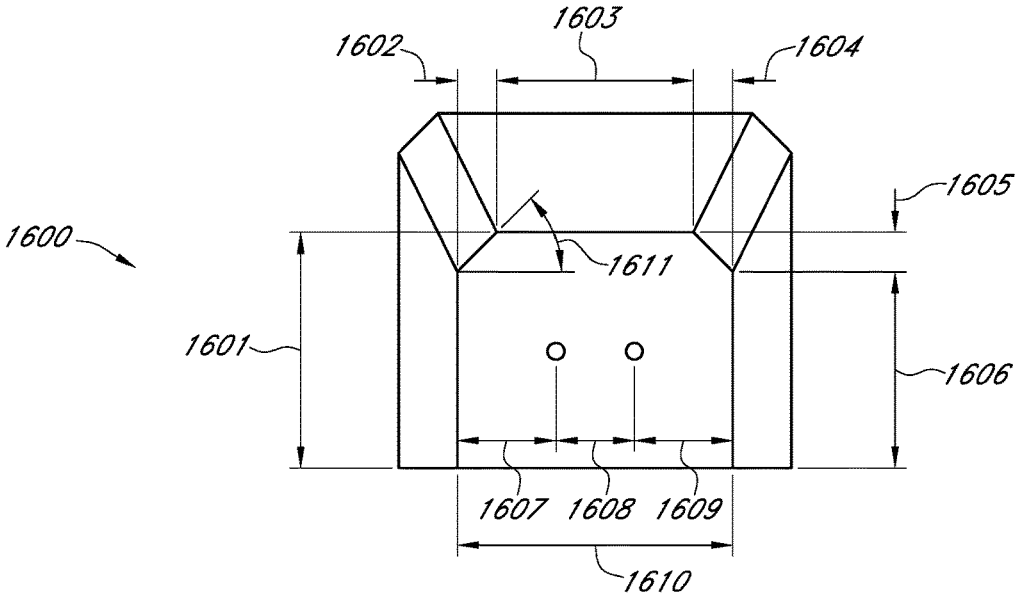

A concrete pylon base is depicted in FIGS. 16-19, as follows:

FIG. 16 shows a superior view of the a base of the post.

Figure 17:
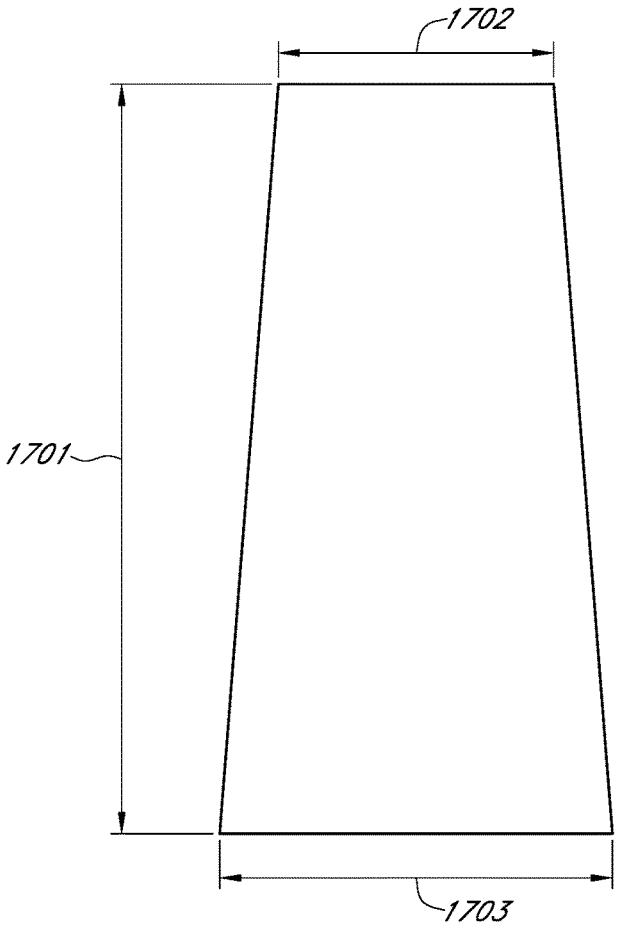

FIG. 17 shows a posterior view of the pylon base of the post.

Figure 18:
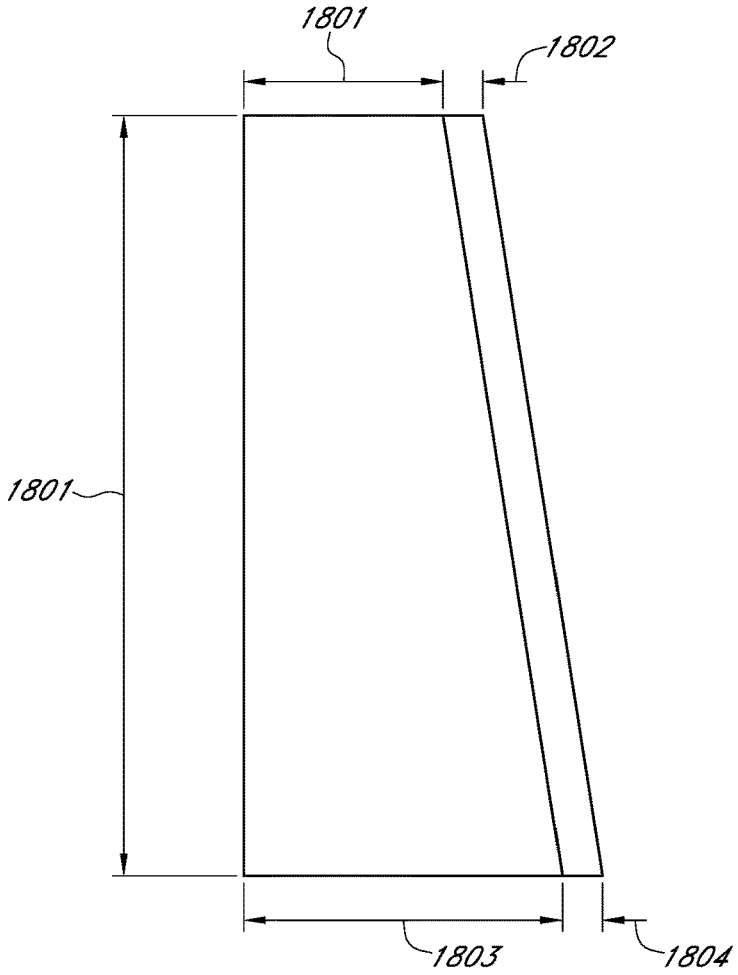

FIG. 18 shows a lateral view of the pylon base of the post.

Figure 19:
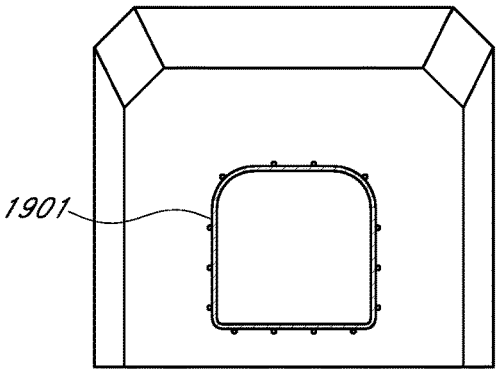

FIG. 19 shows an internal superior view of the pylon base of the post, pointing out the galvanized wire cage within it.

Figure 20:
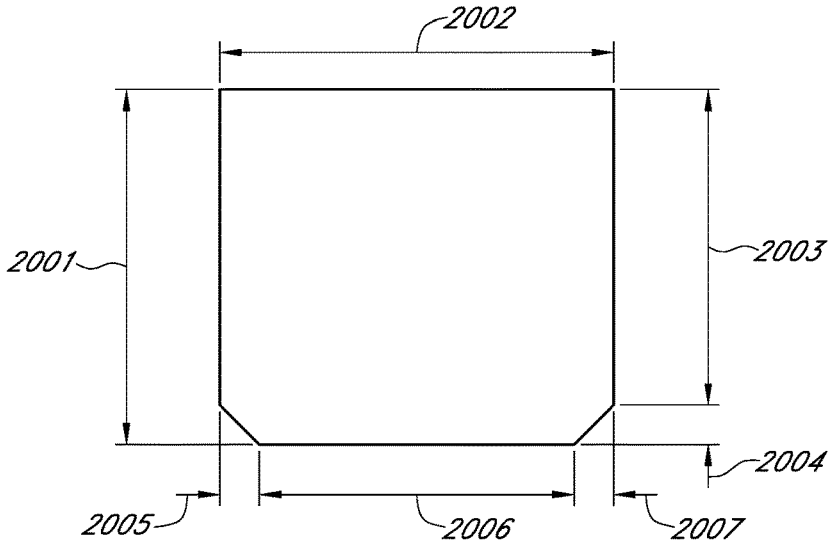

FIG. 20 shows an inferior view of the base of the pylon base of the post.

Figure 21:
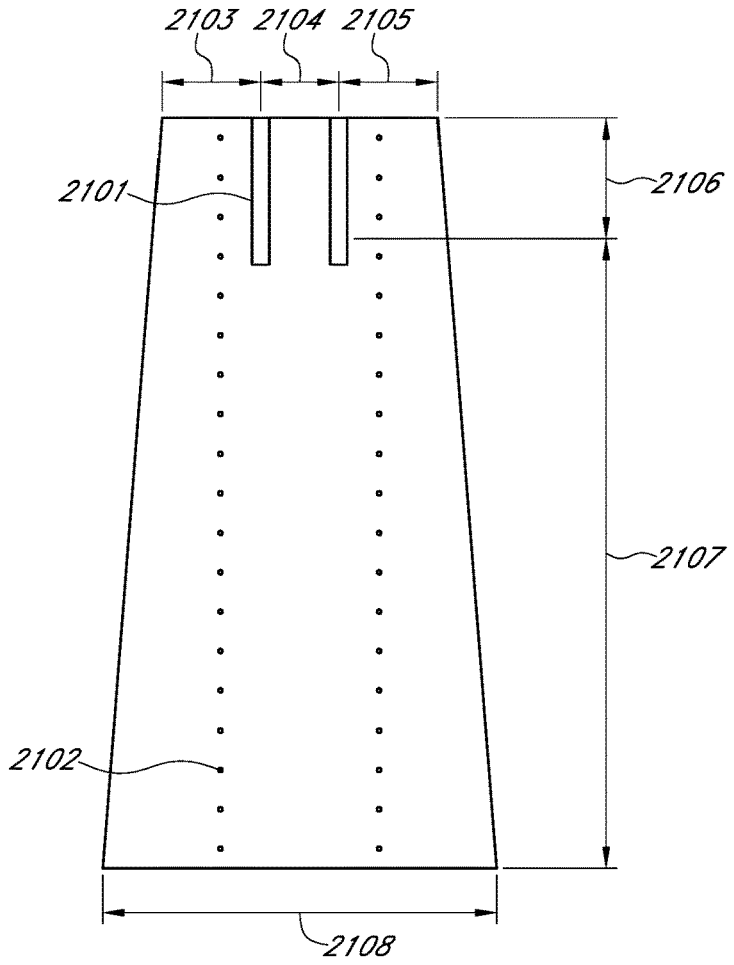

FIG. 21 shows an internal posterior view of the pylon base of the post, with the galvanized wire cage within it and the holes where the rebar is to be inserted.

Figure 22:
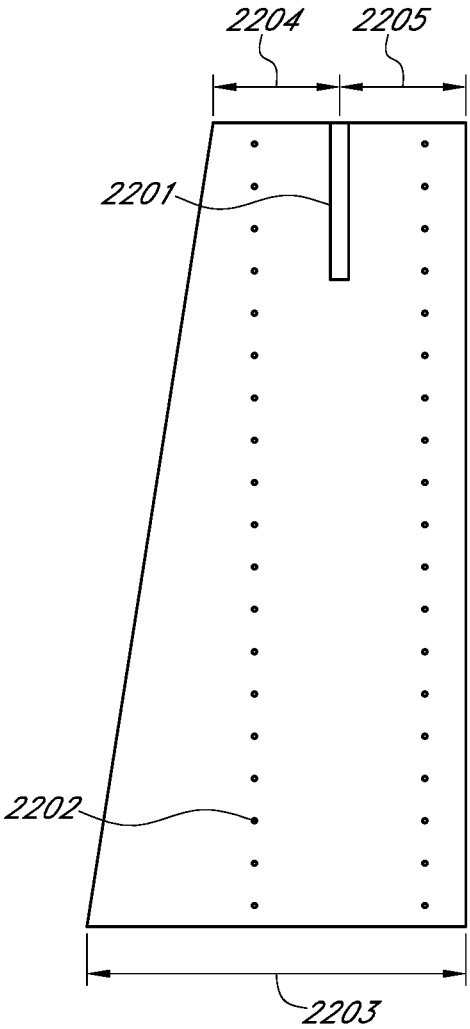

FIG. 22 shows an internal lateral view of the pylon base of the post, with the galvanized wire cage within it and the holes where the rebar is to be inserted.

Figure 23:
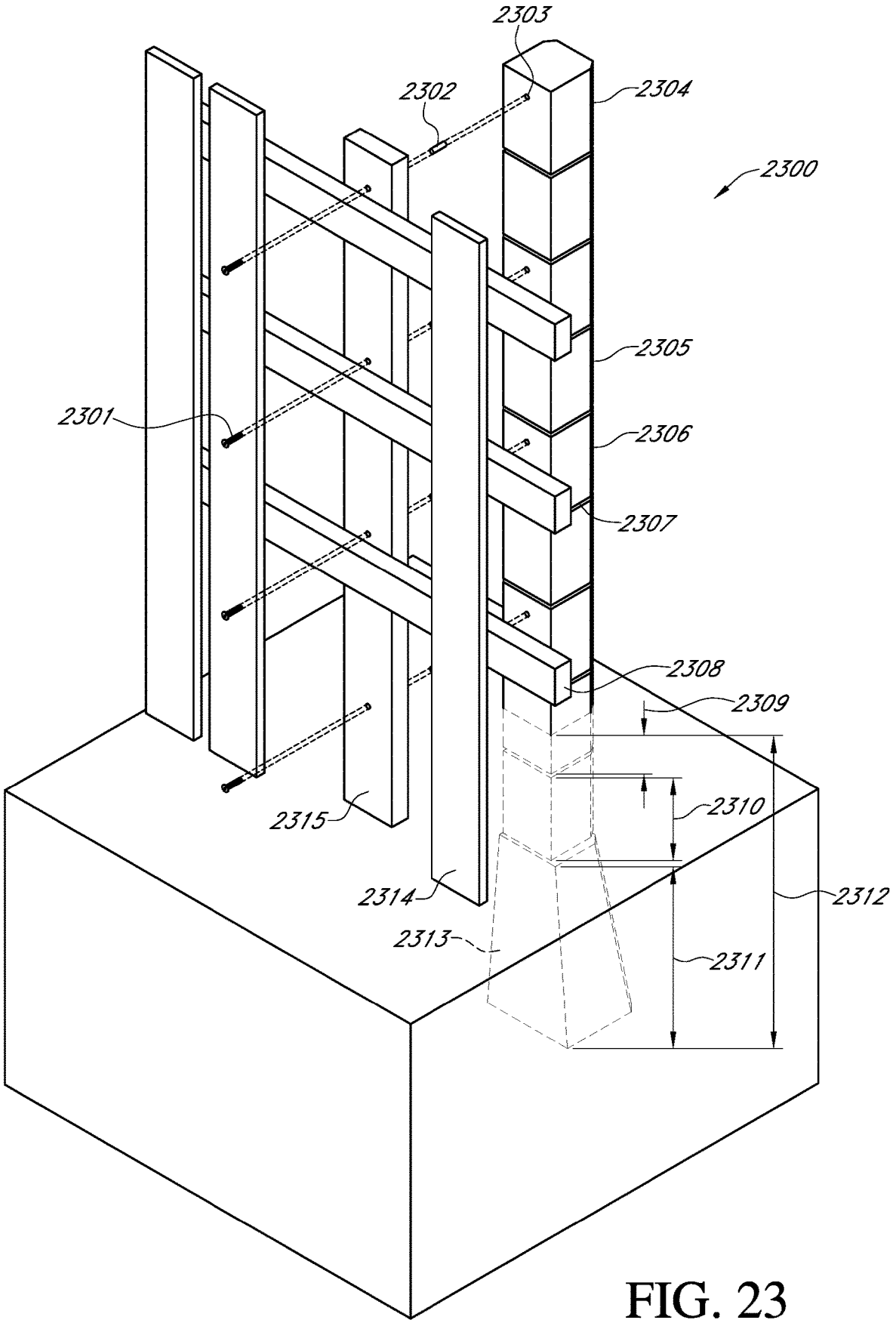

FIG. 23 shows this invention used in standard privacy fencing.

Figure 24:
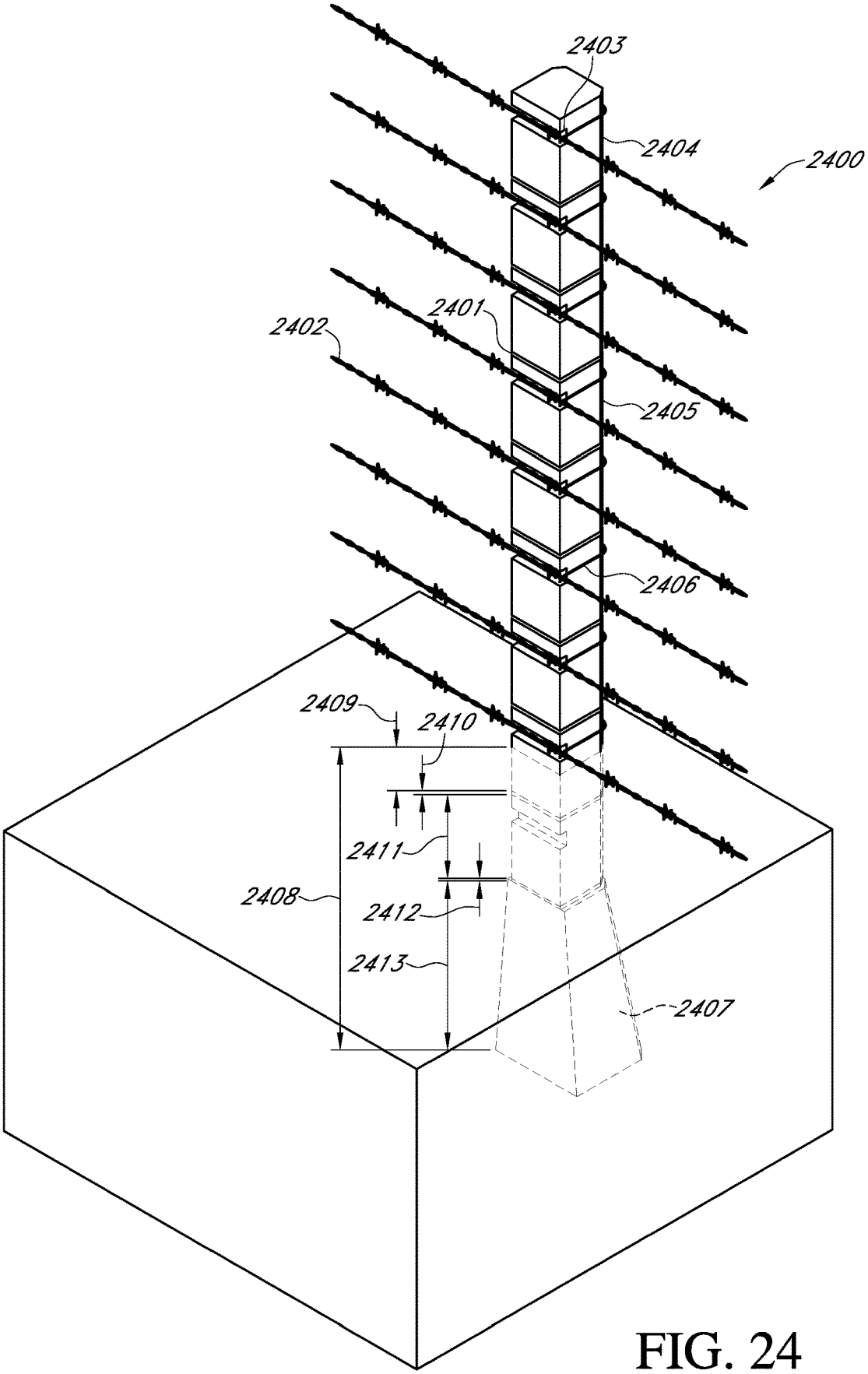

FIG. 24 shows this invention used in barbed wire fencing.

Figure 25:
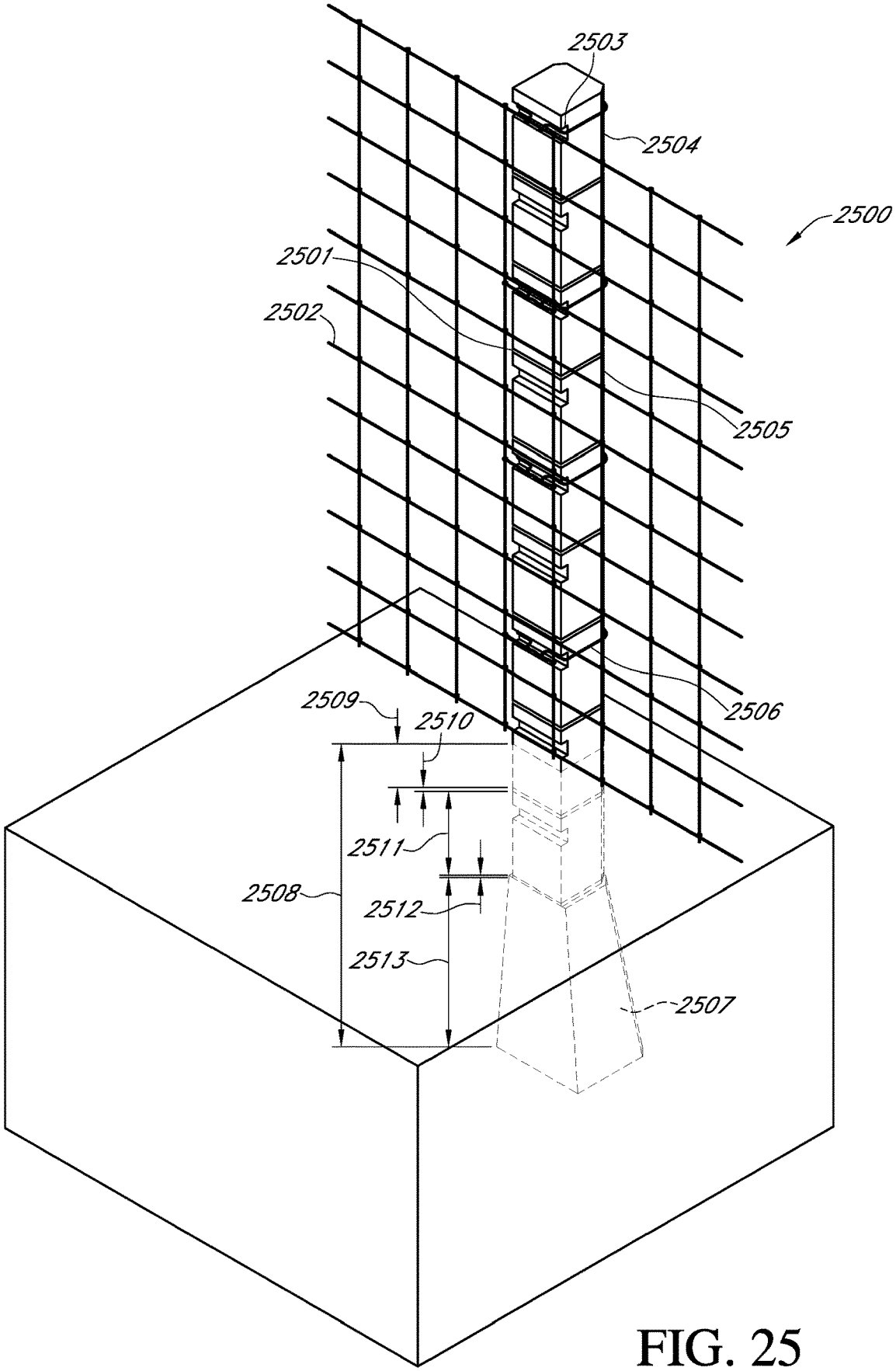

FIG. 25 shows this invention used in woven wire fencing.

Figure 26:
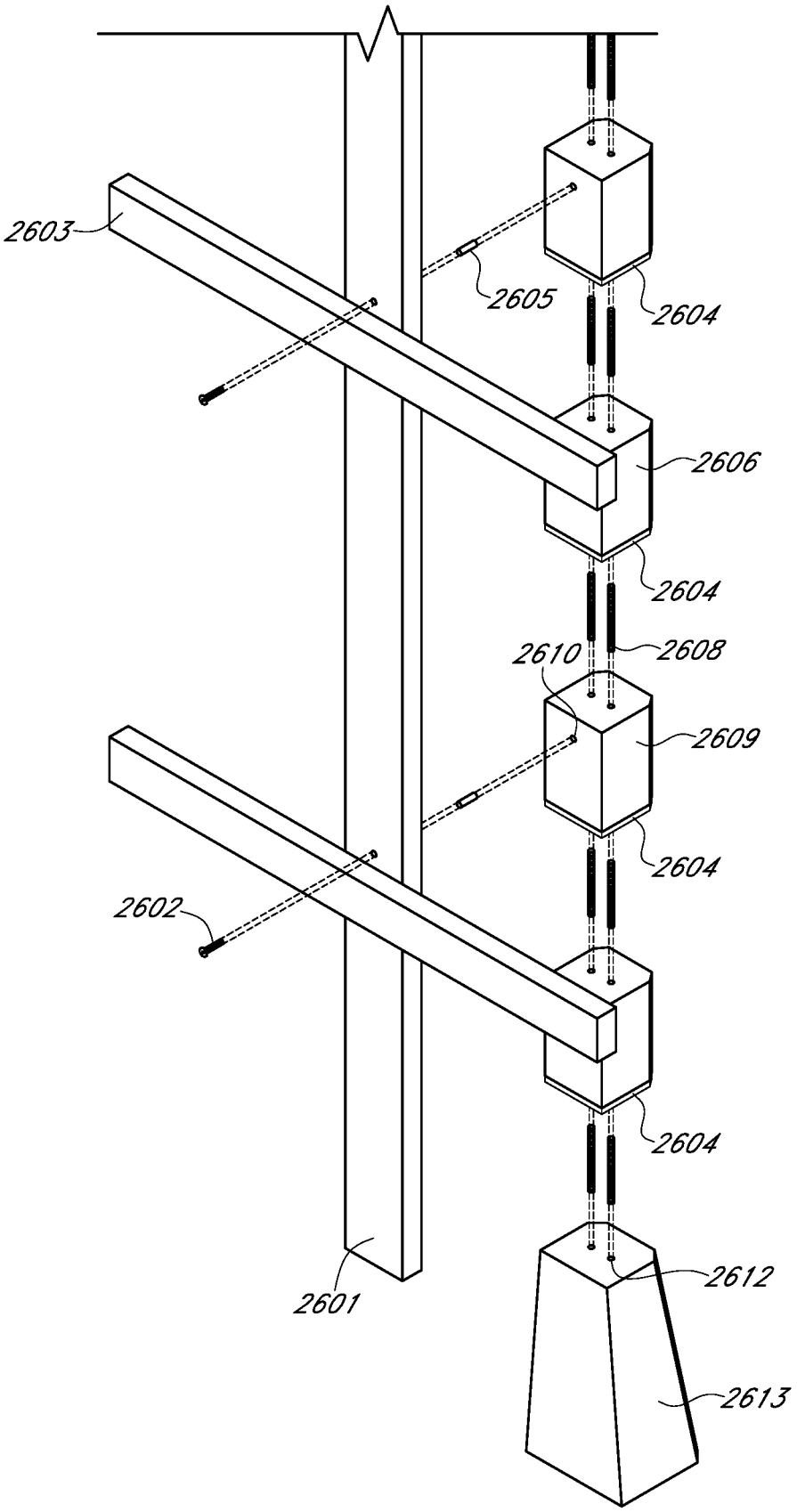

FIG. 26 shows the construction of the post. This invention consists of a pylon base and multiple modules such as 9 more or less modules. Please note, the picture does not show all the modules.

Figure 27:
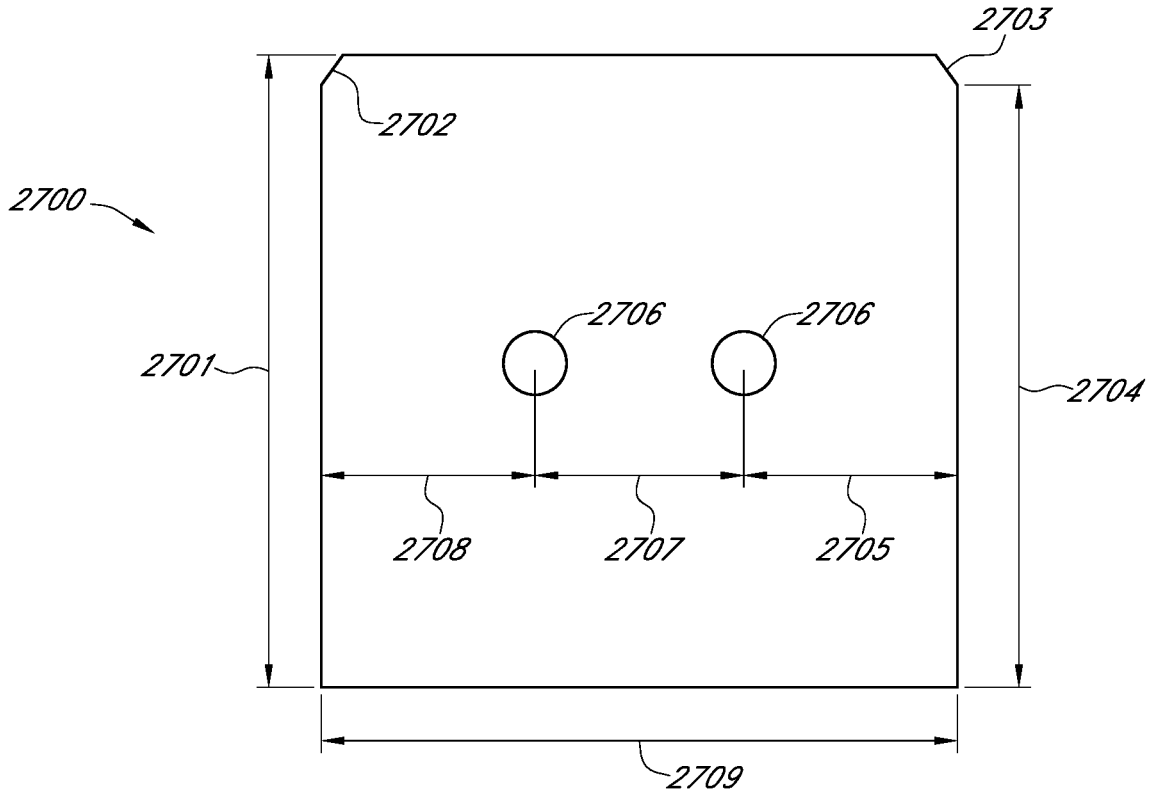

FIG. 27 shows another view of one of another module used in the post.

Figure 28:
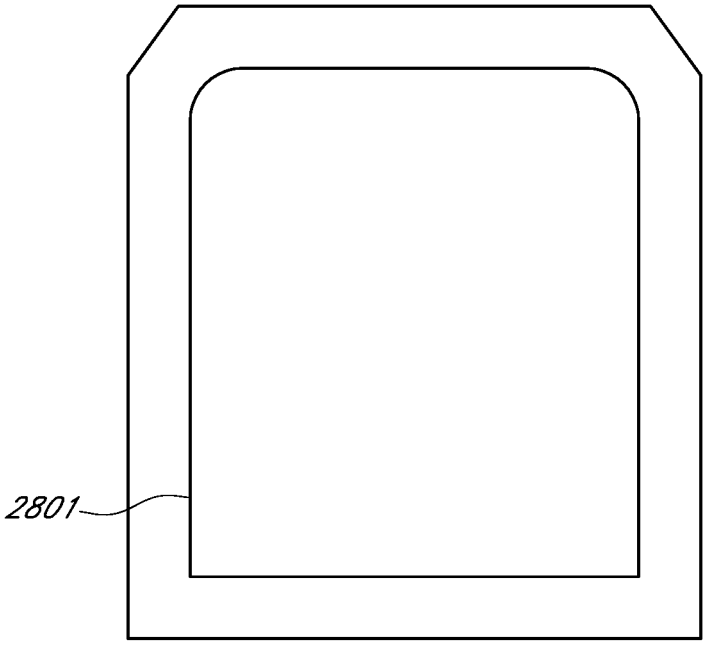

FIG. 28 shows another view of the module in FIG. 27 showing the wire cage in the module.

Figure 29:
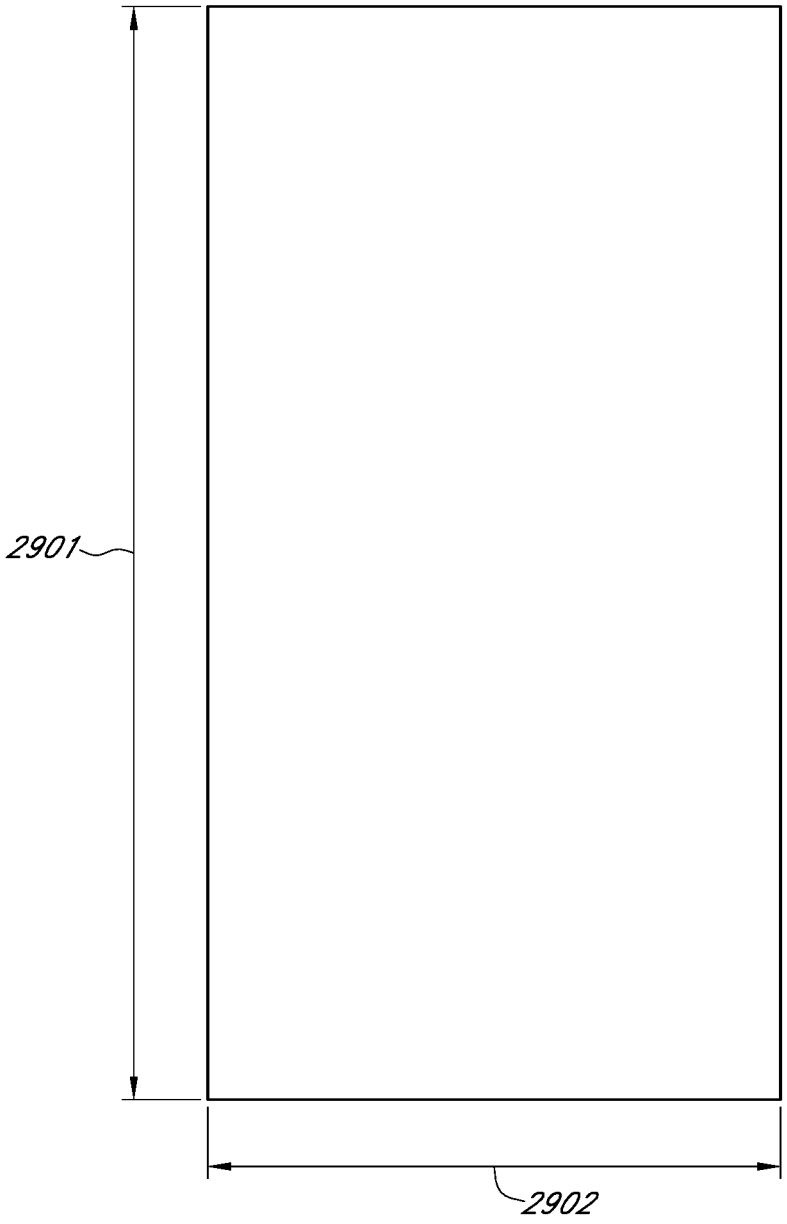

FIG. 29 shows another posterior view of the module in FIG. 27.

Figure 30:
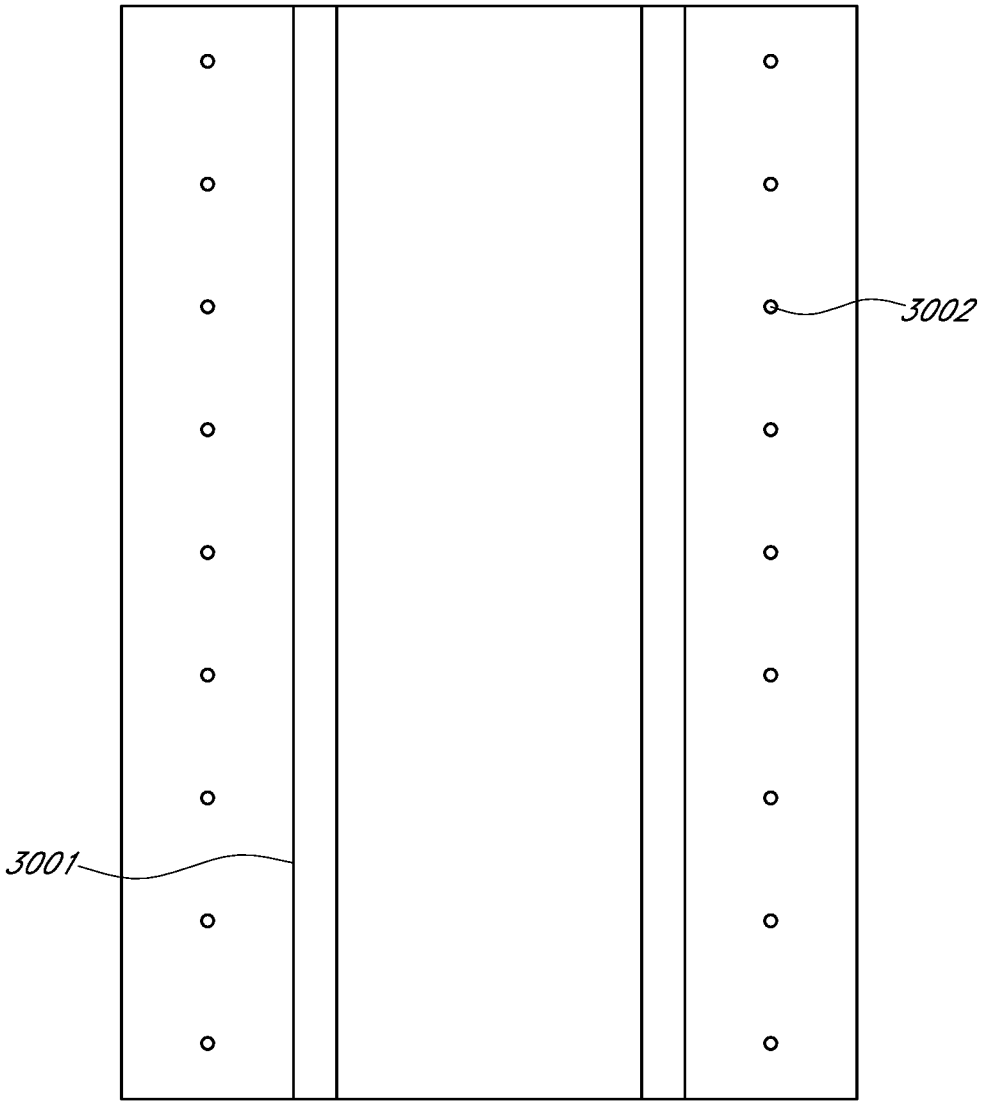
Figure 30:
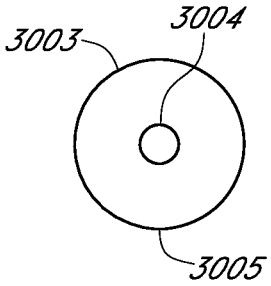

FIG. 30 shows an interior view of the module of FIG. 27 showing the wire cage.

Figure 31:
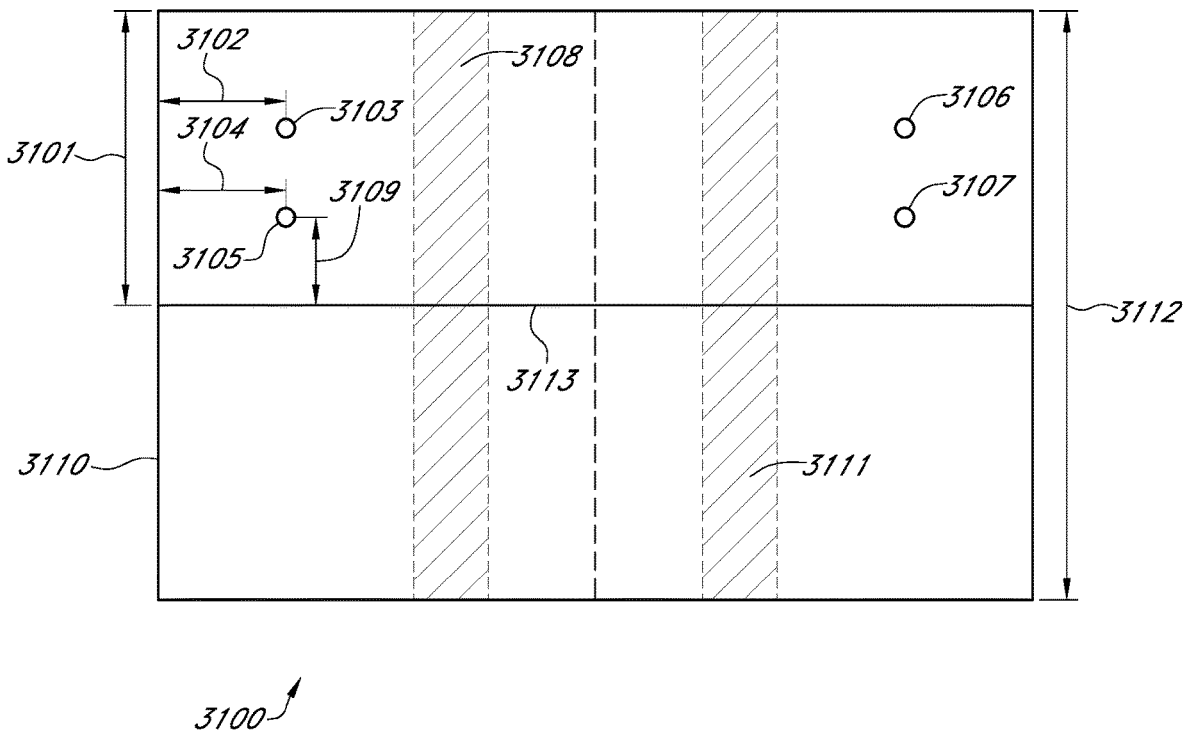

FIG. 31 is another interior view of the module of FIG. 27.

Figure 32:
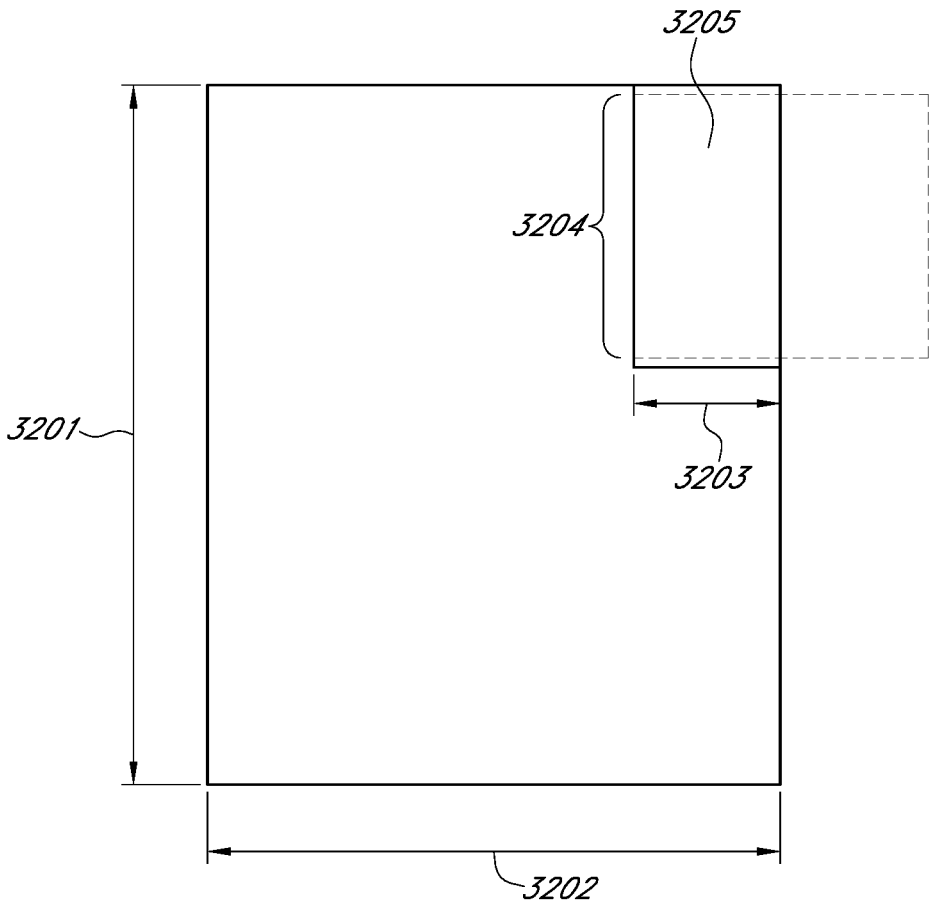

FIG. 32 is a side view of the module of FIG. 27, showing a notch.

Figure 33:
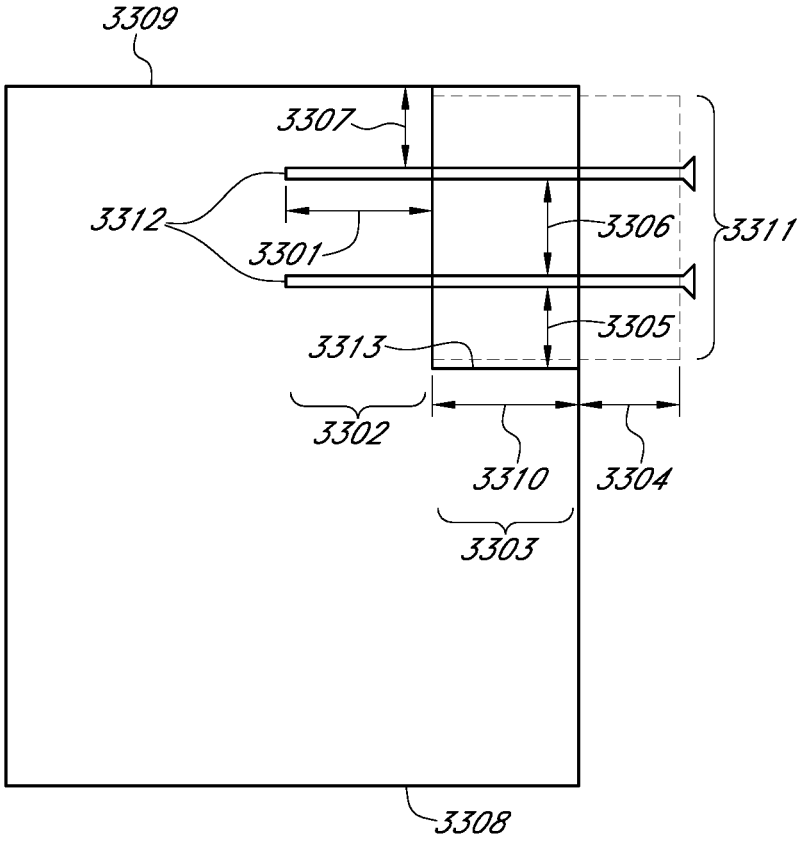

FIG. 33 is a side view of the module of FIG. 27 showing concrete anchors inserted in the module.

Figure 34:
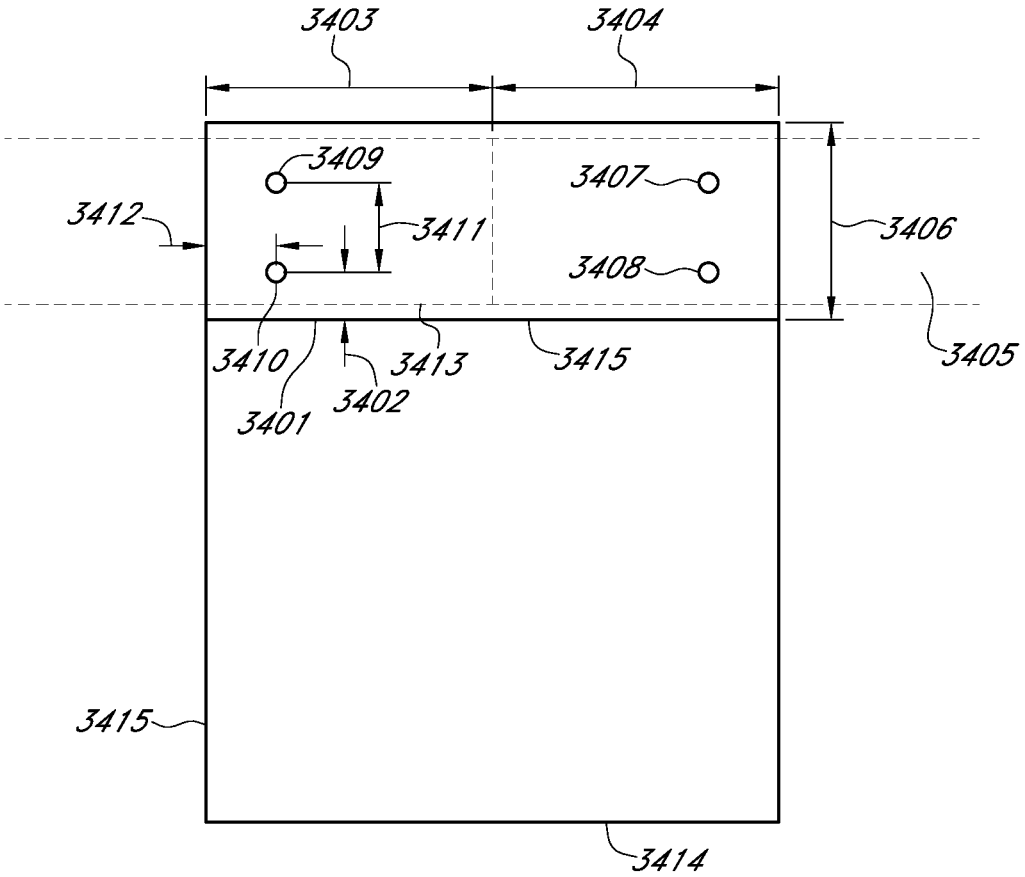

FIG. 34 is a side view of the module of FIG. 27, showing holes for the concrete anchors.

Figure 35:
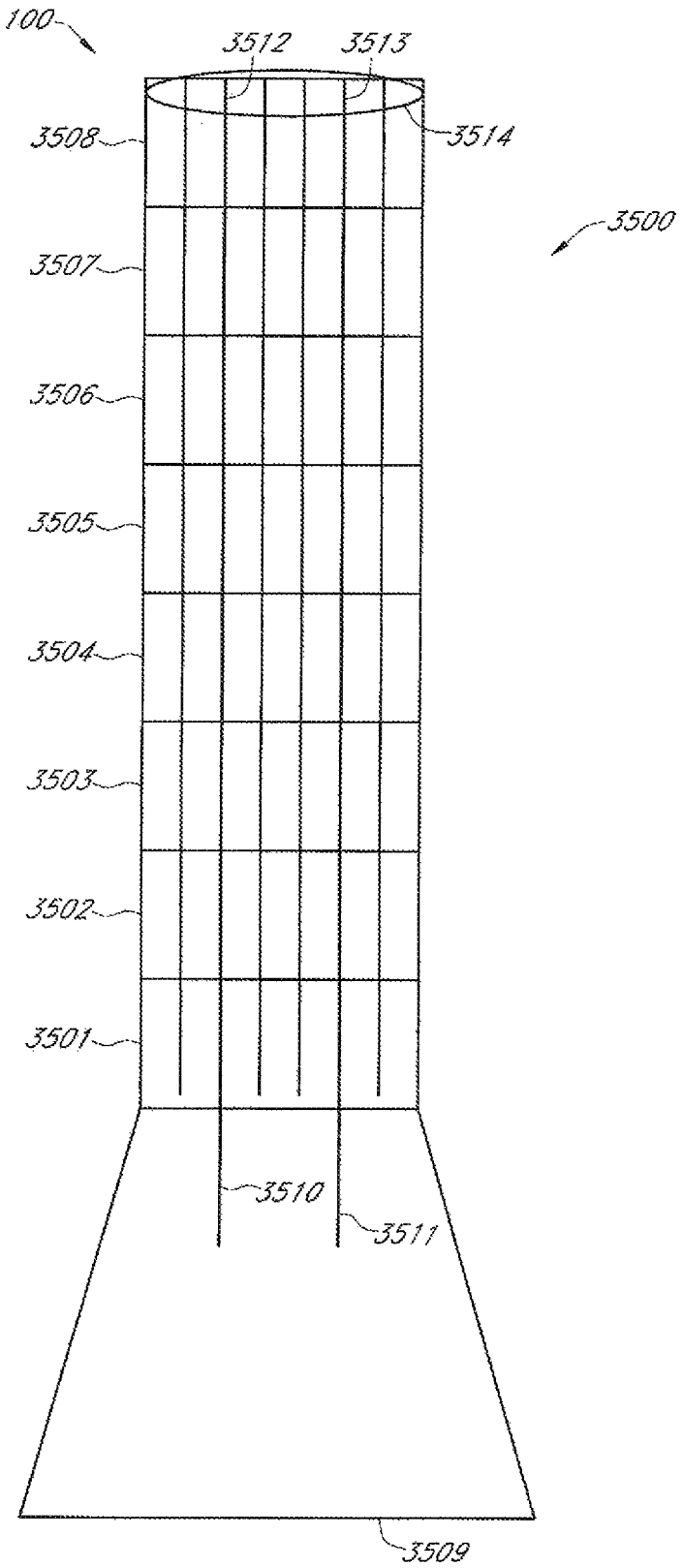

FIG. 35 is an interior view of the post, showing the wire cage and rebar.

Figure 36:
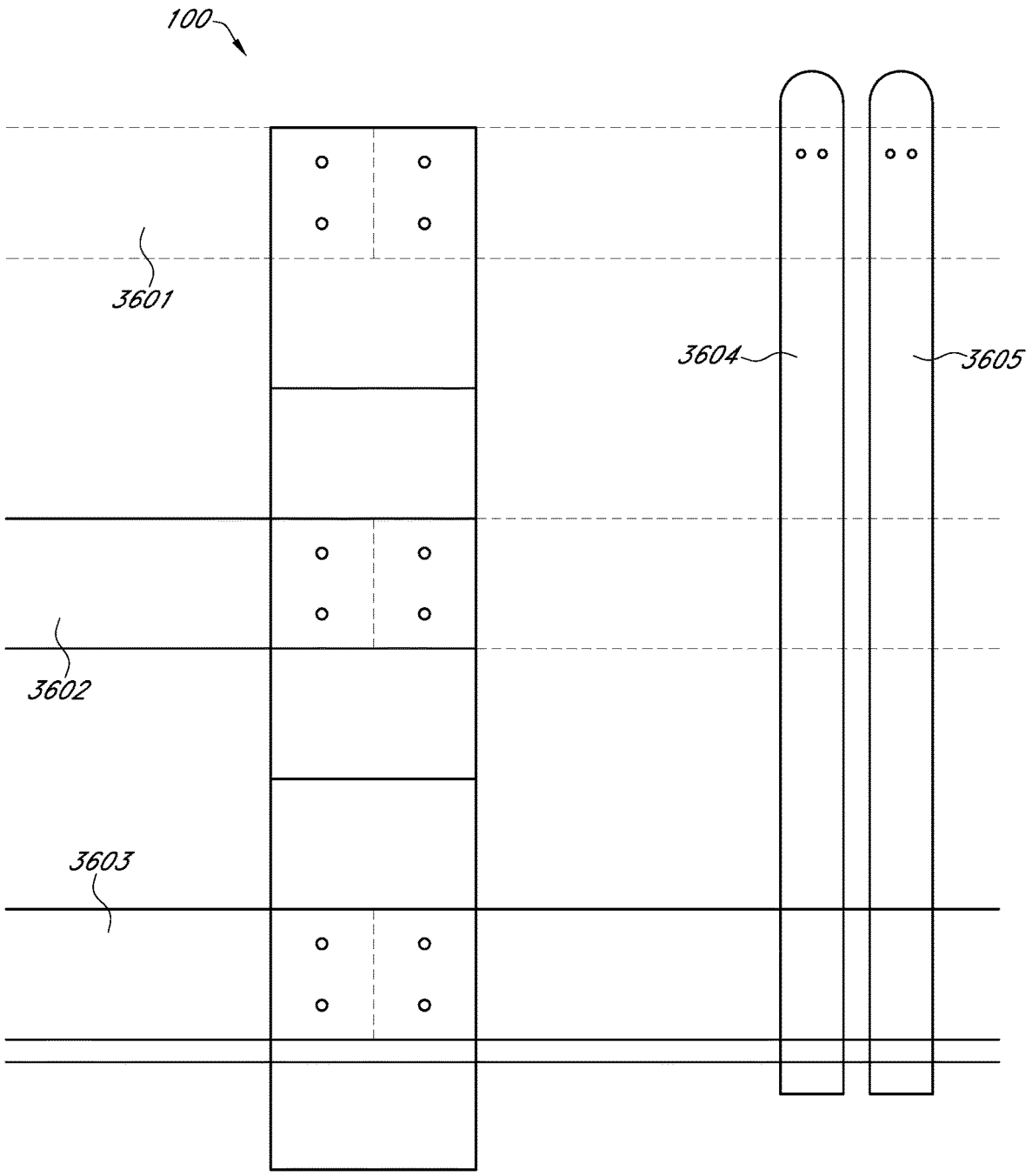

FIG. 36 is a side view of the post connected to fencing.

DETAILED DESCRIPTION OF THE INVENTION

The invention is a post. Each post consists of a concrete pylon base and 9 or more or less concrete modules. Please see FIGS. 23, 24, and 25 to get an idea what the post would look like.

The concrete pylon base and the modules are made out of cement, reinforced by a galvanized wire cage within the cement, and formed using a mold. The pylon base and the modules have specifically designed holes where the rebar is to be inserted; in addition, the modules have specific notch where the barbed and woven wire sit on. Please see FIGS. 16-22 for the position of the wire cage, the shape, and the dimension of the pylon base, and FIGS. 1-15 for the modules. The dimensions given are important to the success of the invention.

To build a post, a pylon base and multiple modules are stacked vertically, reinforced by rebar, anchoring cement and waterproof silicone. Below are the steps to build a post:

Dig a hole in the ground big and tall enough to bury the units that sit below the ground level (a pylon base, a module and half of a module). See FIGS. 23, 24, and 25 for the size of the hole needed. To determine the depth in which to place the post, determine the height that the fence is desired to be from the ground. The post should be placed one third of the height of the fence into the ground.

Lower a pylon base into the ground. On the top side of the pylon base, fill in the rebar holes with epoxy or anchoring cement and insert the rebar into the holes.

Apply mortar or waterproof silicone on top of the pylon base.

Prepare the module that is to be stacked on top of the pylon base by filling in the module's bottom holes with epoxy or anchoring cement.

Stack the module on top of the pylon base by inserting the rebar that is sticking out from the pylon base top to the bottom holes of the module.

Apply pressure to compress the mortar to a ⅜-inch gap. Level the post from the top, front, back and sides. Trowel off the excess mortar, if any. If waterproof silicone is used, apply pressure to connect the modules and/or pylon base and remove any excess waterproof silicone.

We now have a post consisting the pylon base and one module stacked vertically.

On the top side of the post, fill in the rebar holes with epoxy or anchoring cement and insert the rebar into the holes.

Apply mortar or anchoring cement on the top side of the post.

Prepare the next module that is to be stacked on top of the post by filling in the module bottom holes with epoxy or anchoring cement.

Stack the module on top of the post by inserting the rebar that is sticking out on the top side of the post to the bottom holes of the module.

Apply pressure to compress the mortar to a ⅜-inch gap. Level the post from the top, front, back and sides. Trowel off the excess mortar, if any. If waterproof silicone is used, apply pressure to connect the modules and/or pylon base and remove any excess waterproof silicone.

We now have a post consisting a pylon base and 2 modules stacked vertically.

Do the next stacking by repeating steps 7-11 until all the modules (9 or more or less) have been completed. Please see FIG. 26 as a reference.

FIGS. 1, 2, 3, 4, 5, 6, depict top, front, and side views of a module and its overall dimensions, the wire cage within the module, and the holes where the rebar would be inserted.

Figure 1:
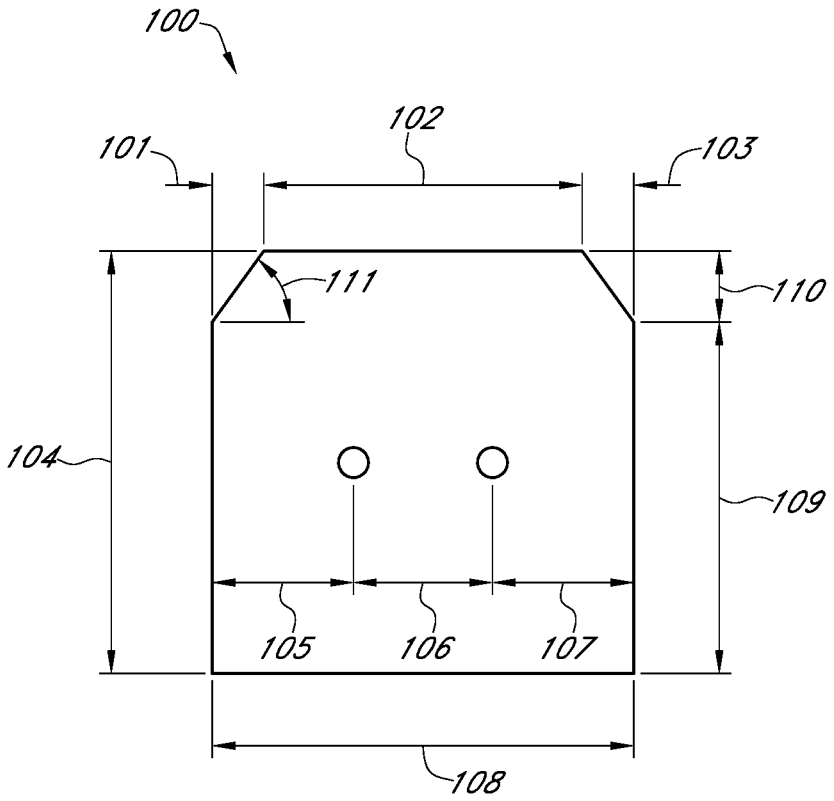
FIG. 1 shows a superior view of a module.

Regarding FIG. 1, a module 100 to be used in the post is shown. The dimension at 101 is ¾ inches, the dimension at 102 is 4½ inches, the dimension at 103 is ¾ inches, the dimension at 104 is 6 inches, the dimension at 105 is 2 inches, the dimension at 106 is 2 inches, the dimension at 107 is 2 inches, the dimension at 108 is 6 inches, the dimension at 109 is 5 inches, the dimension at 110 is 1 inch, and the angle at 111 is 54 degrees.

Figure 2:
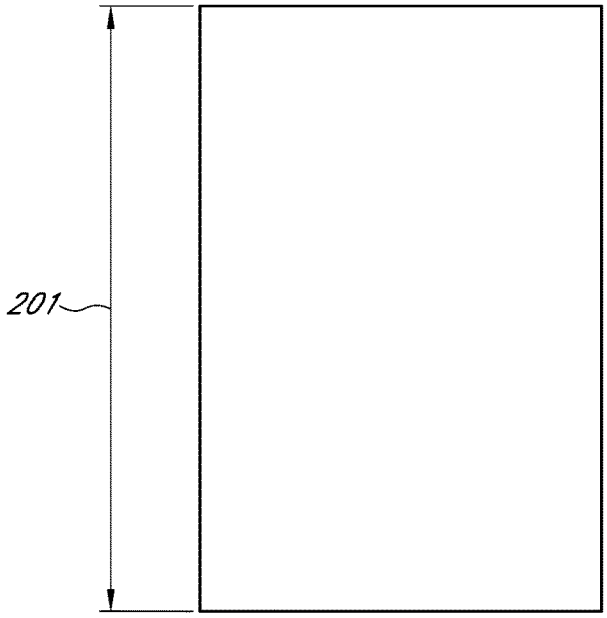
FIG. 2 shows a posterior view of the module in FIG. 1.

FIG. 2 is a posterior view of the module in FIG. 1. Regarding FIG. 2, the dimension at 201 is 9 inches.

Figure 3:
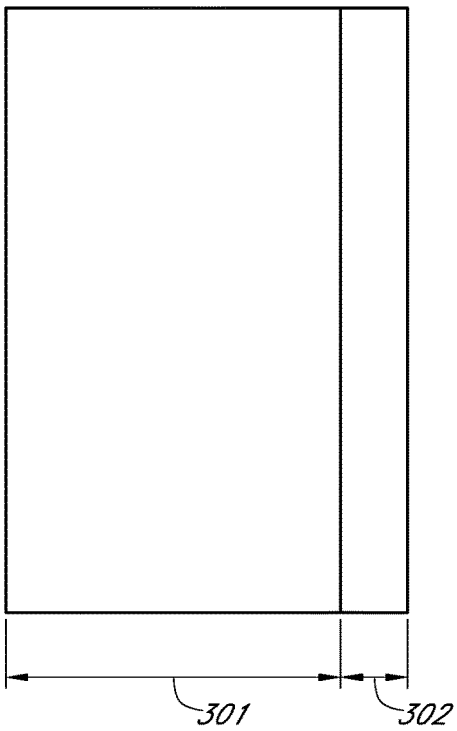
FIG. 3 shows a lateral view of a side of the module of FIG. 1.

FIG. 3 shows a lateral view of a side of the module of FIG. 1. Regarding FIG. 3, the dimension at 301 is 5 inches. The dimension 302 is 1 inch.

Figure 4:
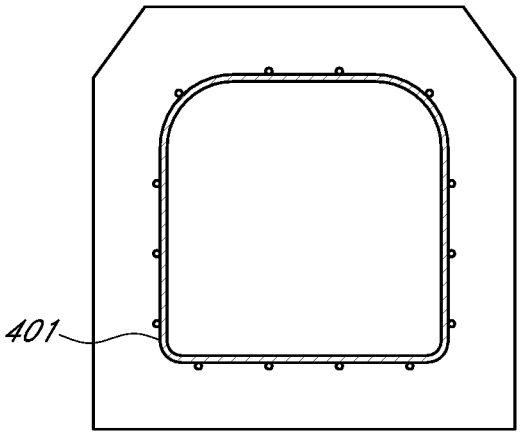
FIG. 4 shows a superior view of the inside of the module of FIG. 1, specifically the galvanized wire cage within the module.

FIG. 4 shows a superior view of the inside of the module of FIG. 1, specifically the galvanized wire cage within the module. Regarding FIG. 4, the cage 401 is a 16 ga (16 gauge), one inch by one inch galvanized wire cage.

Figure 5:
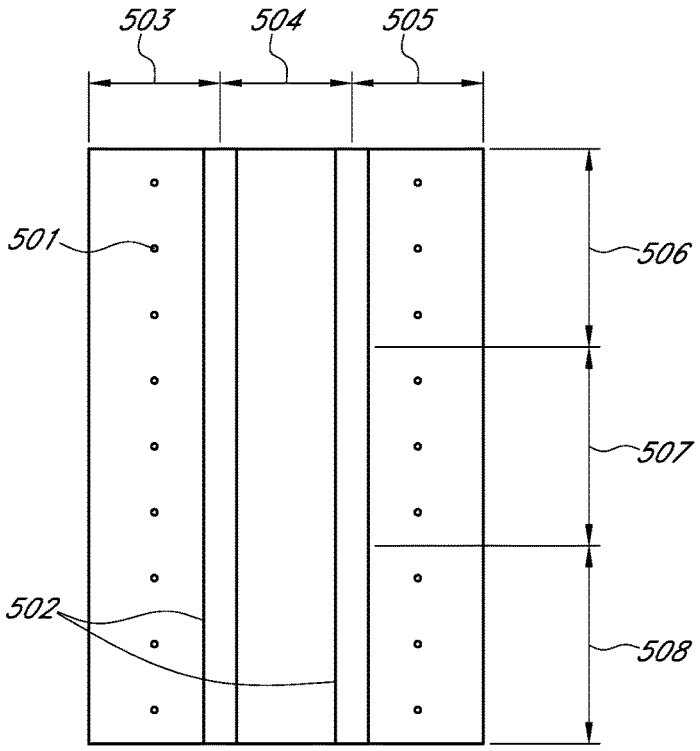
FIG. 5 shows an internal posterior view of the module of FIG. 1, specifically the galvanized wire cage and the holes where rebar is to be inserted.

FIG. 5 shows an internal posterior view of the module of FIG. 1, specifically the galvanized wire cage and the holes where rebar is to be inserted. Regarding FIG. 5, the cage 501 is a 16 ga (16 gauge) 1 inch by 1 inch galvanized wire cage. The two holes 502 for rebar are ¾ inches by 9 inches. The dimension at 503 is 2 inches. The dimension at 504 is 2 inches. The dimension at 505 is 2 inches. The dimension at 506 is 3 inches. The dimension at 507 is 3 inches. The dimension at 508 is 3 inches.

Figure 6:
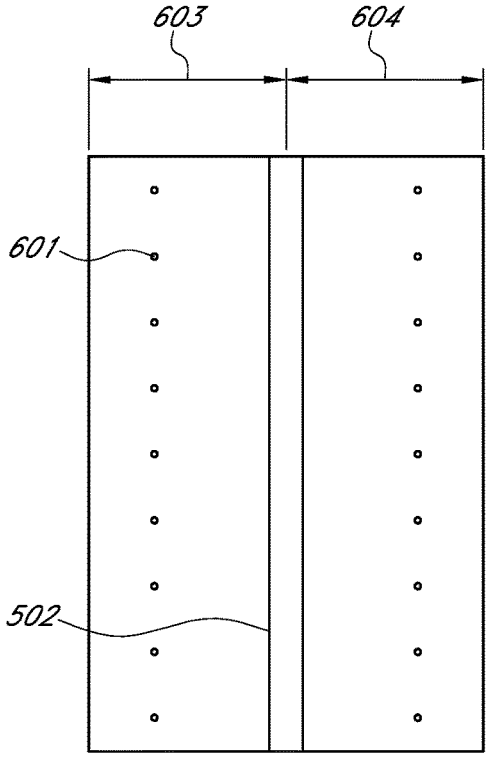
FIG. 6 shows an internal lateral view of the module of FIG. 1, providing views of the galvanized wire cage and the holes where rebar is to be inserted.

FIG. 6 shows an internal lateral view of the module of FIG. 1, providing views of the galvanized wire cage and the hole where rebar is to be inserted. As this is a side view of FIG. 5, only one hole 502 is shown as the holes from FIG. 5 are lined up behind each other. Regarding FIG. 6, the cage 601 is a 16 gauge 1 inch by 1 inch galvanized wire cage. The hole 502 for rebar is ¾ inches by 9 inches.

FIGS. 7, 8, 9, 10, 11 illustrate the socket flat head screw used for attaching different fencing materials to the modules. The top, front, and side views of the module demonstrate the hole's position and dimension and the size of the socket flat head screw.

Figure 7:
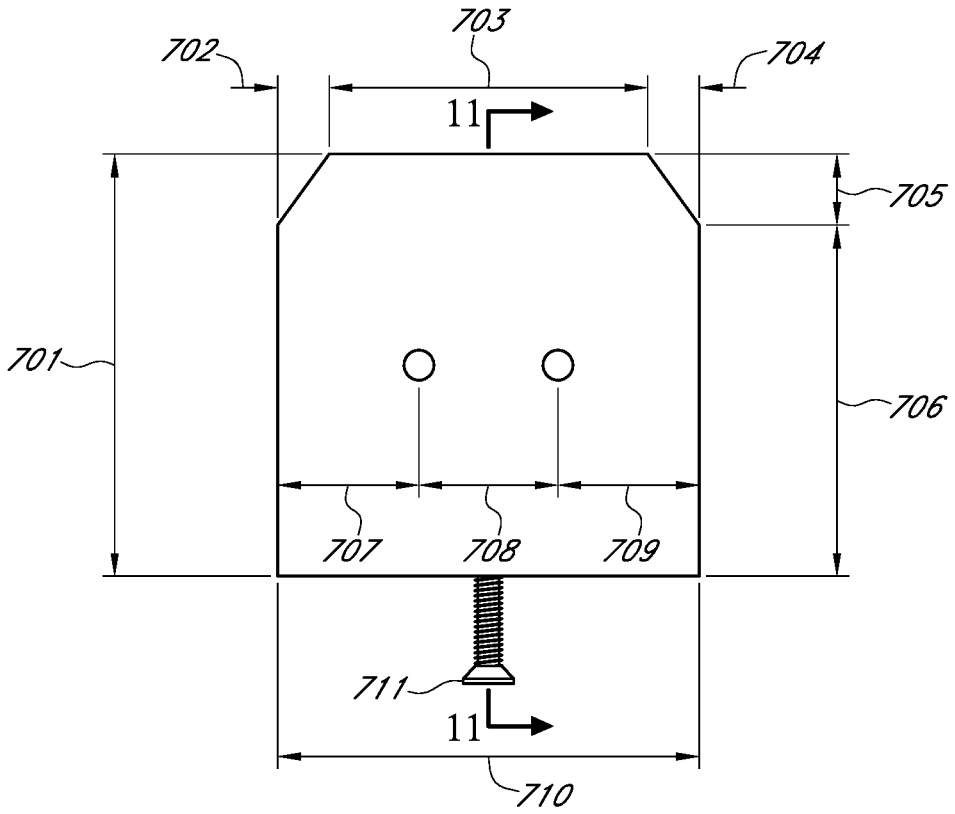
FIG. 7 shows a superior view of the module of FIG. 1, pointing out a bolt for a privacy or rail fence application.

FIG. 7 shows a superior view of the module of FIG. 1, pointing out a bolt for privacy fence or rail fence application. Regarding FIG. 7, the dimension 701 is 6 inches. The dimension 702 is ¾ inches. The dimension 703 is 4 and ½ inches. The dimension 704 is ¾ inches. The dimension 705 is 1 inch. The dimension 706 is 5 inches. The dimension 707 is 2 inches. The dimension 708 is 2 inches. The dimension 709 is 2 inches. The dimension 710 is 6 inches. The screw 711 is a ⅜-16 by 2 inch socket flat head screw.

Figure 8:
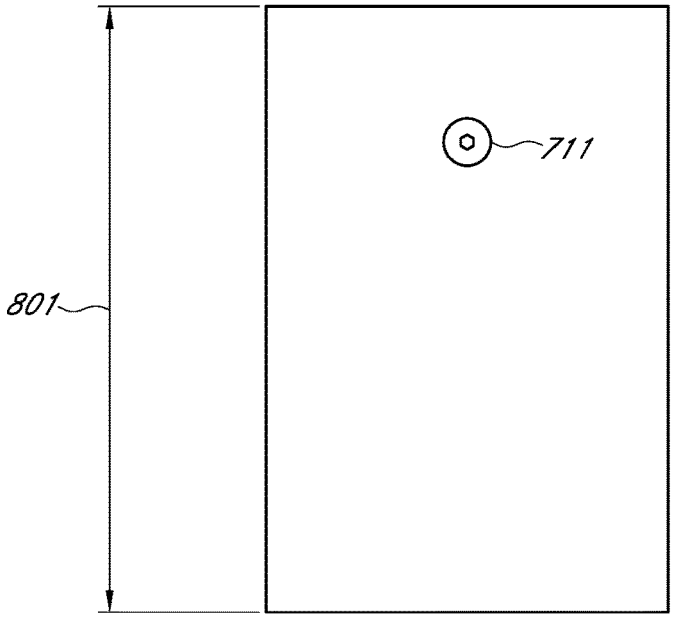
FIG. 8 shows a posterior view of the module of FIG. 1, pointing out the bolt for a privacy or rail fence application.

FIG. 8 shows a posterior view of the module of FIG. 1, pointing out the bolt for barbed wire fence and woven wire fence application. Regarding FIG. 8, the dimension 801 is 9 inches, and the screw 711 is a ⅜-16 by 2 inch socket flat head screw.

Figure 9:
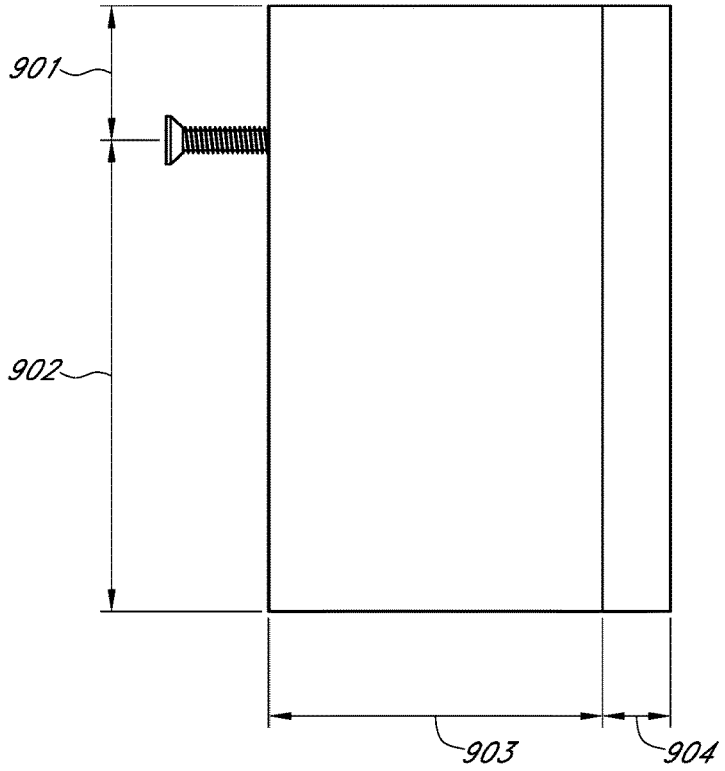
FIG. 9 shows a lateral view of the module of FIG. 1, pointing out the bolt for a privacy or rail fence application.

FIG. 9 shows a lateral view of the module of FIG. 1, pointing out the bolt for barbed wire fence and woven wire fence application. Regarding FIG. 9, the dimension 901 is 2 inches, the dimension 902 is 7 inches. The dimension 903 is 5 inches. The dimension 904 is 1 inch.

Figure 10:
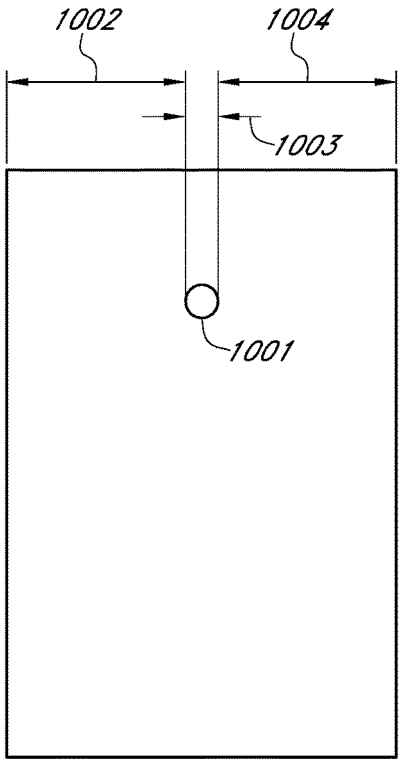
FIG. 10 shows a posterior view of the module of FIG. 1, pointing out a hole prior to the insertion of the bolt.

FIG. 10 shows a posterior view of the module of FIG. 1, pointing out a hole prior to the insertion of the bolt. Regarding FIG. 10, the hole 1001 is a 7/16 by 1 and ⅝ inch hole. The hole 1001 is for a bot to be inserted. The dimension 1002 is 2 and ¾ inches. The dimension 1003 is ½ inches. The dimension 1004 is 2 and ¾ inches.

Figure 11:
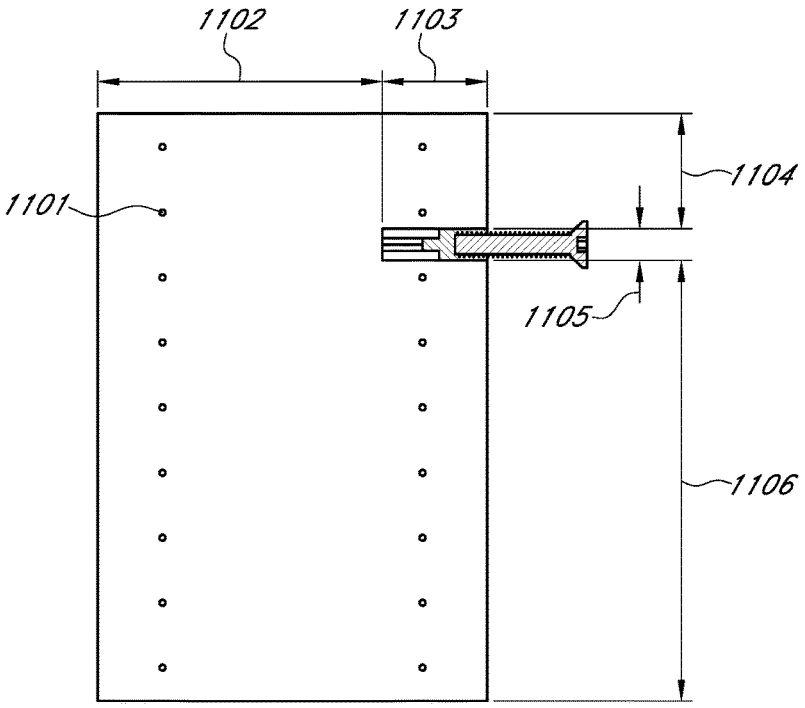
FIG. 11 shows an internal lateral view of the module of FIG. 1 with the bolt in place.

FIG. 11 shows an internal lateral view of the module of FIG. 1 with the bolt in place. Regarding FIG. 11, the cage 1101 is a 16 ga 1 inch by 1 inch galvanized wire cage. The dimension 1102 is 4 and ⅜ inches. The dimension 1103 is 1 and ⅝ inches. The dimension 1104 is 1 and ¾ inches. The dimension 1105 is ½ inch. The dimension 1106 is 6 and ¾ inches.

Figure 12:
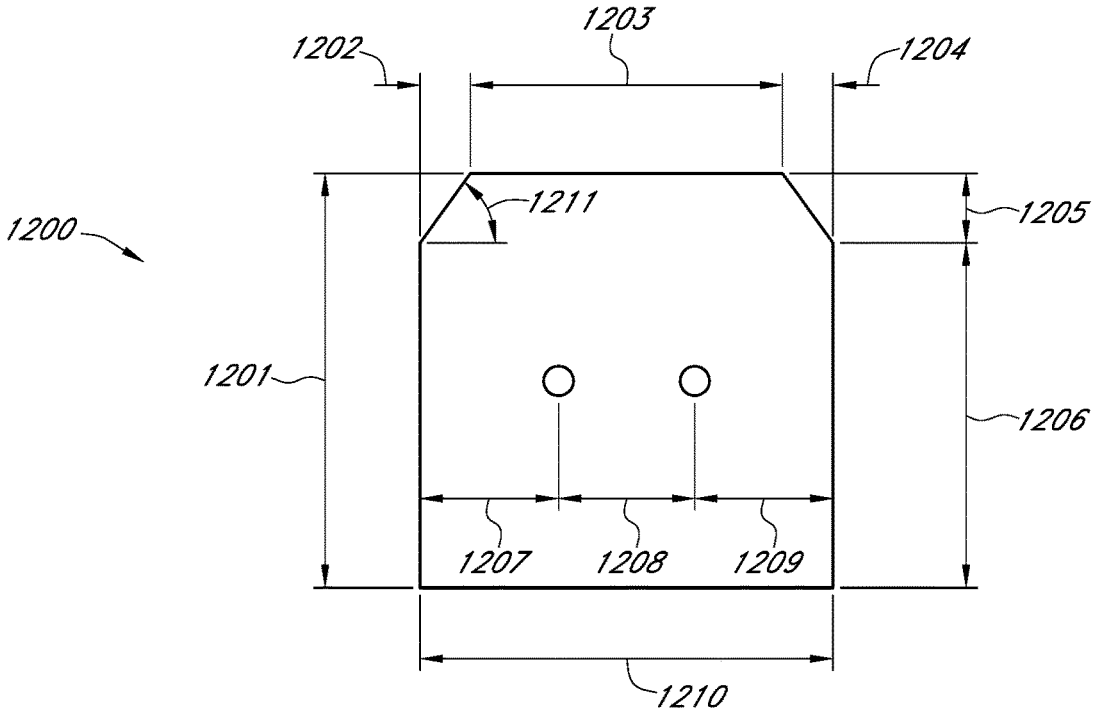
FIG. 12 shows a superior view a module, with an emphasis on the two holes where the rebar is to be inserted.
Figure 13:
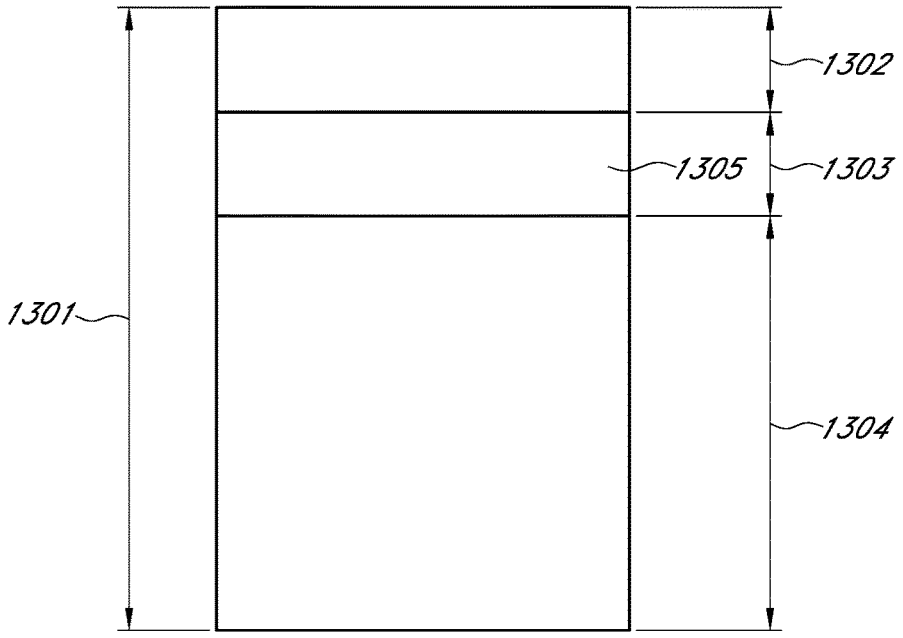
Figure 14:
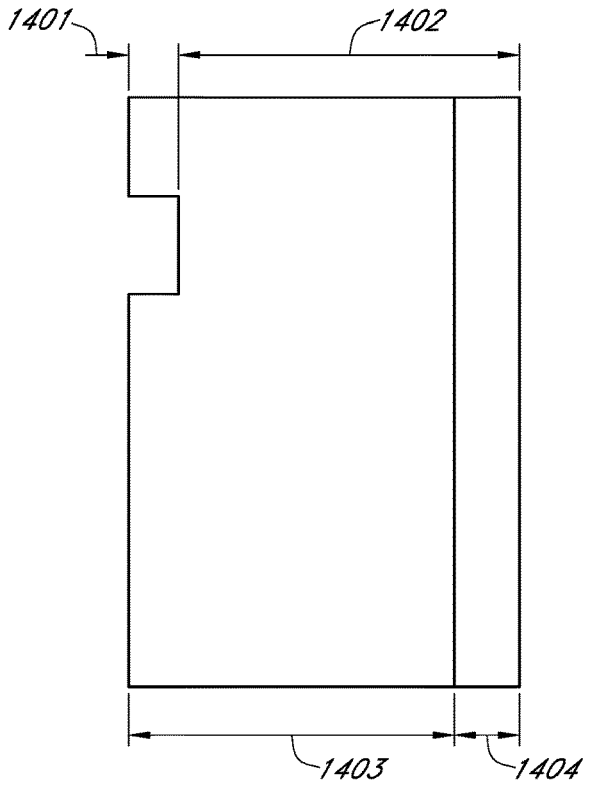
FIG. 14 shows a lateral view of the module of FIG. 12 with a view of the notch for the fencing.
Figure 15:
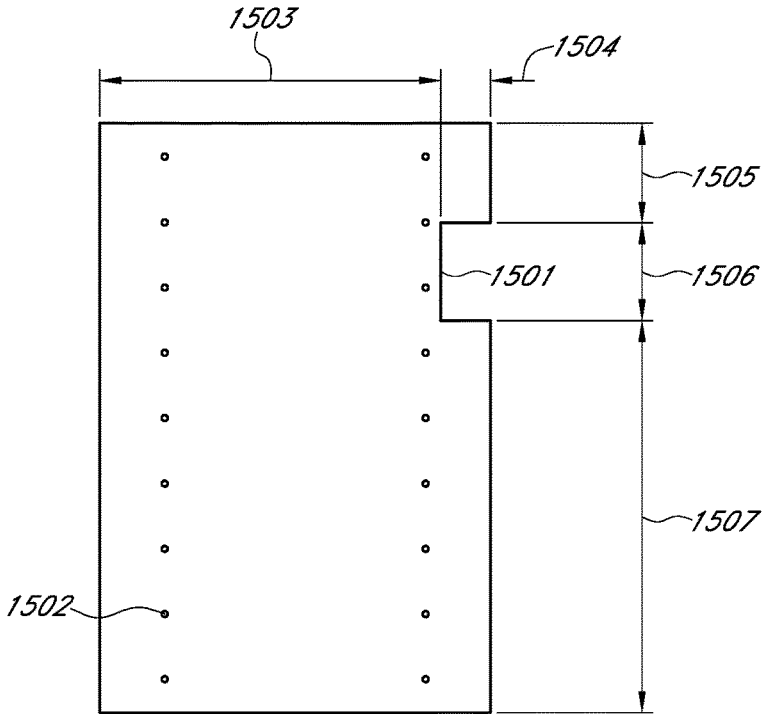
FIG. 15 shows an internal lateral view of the module of FIG. 12 to provide the position of the galvanized wire cage in relation to the notch in a post.

FIG. 12 illustrates the two holes where the rebar would be inserted. FIGS. 13, 14, 15 illustrate notch where a barbed wire or woven wire fence is secured on.

FIG. 12 shows a superior view a module 1200 that is an embodiment of the module of FIG. 1, with an emphasis on the two holes where the rebar is to be inserted. Regarding FIG. 12, the dimension 1201 is 6 inches. The dimension 1202 is ¾ inches. The dimension 1203 is 4 and ½ inches. The dimension 1204 is ¾ inches. The dimension 1205 is 1 inch. The dimension 1206 is 5 inches. The dimension 1207 is 2 inches. The dimension 1208 is 2 inches. The dimension 1209 is 2 inches. The dimension 12010 is 6 inches. The angle 1211 is 54 degrees.

FIG. 13 shows a posterior view of the module of FIG. 12, showing a notch where the wire or barbed wire fencing lays in. Regarding FIG. 13, the dimension 1301 is 9 inches. The dimension 1302 is 1 and ½ inches. The dimension 1303 is 1 and ½ inches. The dimension 1304 is 6 inches. The dimension of a notch 1305 is 1 and ½ inches by ¾ inches.

FIG. 14 shows a lateral view of the module of FIG. 12 with a view of the notch for the fencing. Regarding FIG. 14, dimension 1401 is ¾ inches, dimension 1402 is 5 and ¼ inches. Dimension 1403 is 5 inches. Dimension 1404 is 1 inch.

FIG. 15 shows an internal lateral view of the module of FIG. 12 to provide the position of the galvanized wire cage in relation to the notch in a post. Regarding FIG. 15, a notch 1501 is of dimensions 1 and ½ inches by ¾ inches. Cage 1502 is a 16 ga 1 inch by 1 inch galvanized wire cage. The dimension at 1503 is 5 and ¼ inches. The dimension 1504 is ¾ inches. The dimension 1505 is 1 and ½ inches. The dimension 1506 is 1 and ½ inches. The dimension 1507 is 6 inches.

FIGS. 16, 17, 18, 19, 20, 21, 22 show a pylon base with its dimensions, the wire cage within the unit, and the holes where the rebar would be inserted.

FIG. 16 shows a superior view of a base 1600 of the post. Regarding FIG. 16, the dimension 1601 is 6 inches. The dimension 1602 is 1 inch. The dimension 1603 is 5 inches. The dimension 1604 is 1 inch. The dimension 1605 is 1 inch. The dimension 1606 is 5 inches. The dimension 1607 is 2 and ½ inches. The dimension 1608 is 2 inches. The dimension 1609 is 2 and ½ inches. The dimension 1610 is 7 inches. The angle at 1611 is 45 degrees.

FIG. 17 shows a posterior view of the pylon base shown in FIG. 16 of the post. Regarding FIG. 17, the dimension 1701 is 1 foot and 7 inches. The dimension 1702 is 7 inches. The dimension 1703 is 10 inches.

FIG. 18 shows a lateral view of the pylon base shown in FIG. 16 of the post. Regarding FIG. 18, the dimension 1801 is 1 foot and 7 inches. The dimension 1801 is 5 inches. The dimension 1802 is 1 inch. The dimension 1803 is 8 inches. The dimension 1804 is 1 inch.

FIG. 19 shows an internal superior view of the pylon base shown in FIG. 16 of the post, pointing out the galvanized wire cage within it. Regarding FIG. 19, cage 1901 is a 16 ga 1 inch by 1 inch galvanized wire cage.

FIG. 20 shows an inferior view of the base of the pylon base shown in FIG. 16 of the post. Regarding FIG. 20, dimension 2001 is 9 inches. Dimension 2002 is 10 inches. Dimension 2003 is 8 inches. Dimension 2004 is 1 inch. Dimension 2205 is 1 inch. Dimension 2006 is 8 inches. Dimension 2007 is 1 inch.

FIG. 21 shows an internal posterior view of the pylon base shown in FIG. 16 of the post, with the galvanized wire cage within it and the holes where the rebar is to be inserted. Regarding FIG. 21, holes 2101 are ½ inch by 3 and 11/16 inches for rebar insertion. Cage 2102 is a 16 ga 1 inch by 1 inch galvanized wire cage. Dimension 2103 is 2 and ½ inches. Dimension 2104 is 2 inches. Dimension 2105 is 2 and ½ inches. Dimension 2106 is 3 inches. Dimension 2107 is 1 foot and 4 inches. Dimension 2108 is 10 inches.

FIG. 22 shows an internal lateral view of the pylon base shown in FIG. 16 of the post, with the galvanized wire cage within it and the holes where the rebar is to be inserted. Regarding FIG. 22, hole 2201 is a ½ inch by 3 and 11/16 inch hole for rebar. Cage 2202 is a 16 ga 1 inch by 1 inch galvanized wire cage. Dimension 2203 is 9 inches. Dimension 2204 is 3 inches. Dimension 2205 is 3 inches.

FIG. 23 depicts an application of this invention for privacy fencing. It shows the drop-in anchors and the socket flat heads that are used to attach the boards to post. Shown at 2300 is the post that is the invention. Regarding FIG. 23, screw 2301 is a ⅜-16 by 2 inch socket flat head screw. Anchor 2302 is a ⅜ inch by 1 and ⅝ inches anchor. Hole 2303 is a 7/16 inch by 1 and ⅝ inch hole. Module 2304 is a standard top fence module. Module 2305 is a standard middle post module. Module 2306 is a standard middle fence module. Mortar 2307 is applied between modules, and compressed to ⅜ inches. Dimension 2308 is 2 inches by 4 inches. Dimension 2309 is 4 and ⅝ inches. Dimension 2310 is 9 inches. Dimension 2311 is 19 inches. Dimension 2312 is 33 and ⅜ inches below ground level. Module 2313 is a standard pylon module. Plank 2314 is a 1 inch by 6 inch plank. Plank 2315 is a 2 inch by 6 inch plank.

FIG. 24 depicts an application of this invention for a barbed wire fence. It shows notch where the barbed wire sits on, which is secured to the modules with tie-backs. Shown at 2400 is an embodiment of the post that is the invention.

Regarding FIG. 24, mortar 2401 is applied between modules (such as 2404, 2405, 2407) and compressed to ⅜ inches. Barbed wire 2402 is inserted into notches 2403. The notches 2403 are 1 and ½ by ¾ inches in dimension. Module 2404 is a standard top wire module. Module 2405 is a standard middle wire module. Tie 2406 is a 12.5 ga galvanized tie. The tie 2406 can affix the barbed wire 2402 to a notch 2403. Module 2407 is a standard pylon module. Dimension 2408 is 33 and ⅜ inches below ground level. Dimension 2409 is 4 and ⅝ inches. Dimension 2410 is ⅜ inches. Dimension 2411 is 9 inches. Dimension 2412 is ⅜ inches. Dimension 2412 is ⅜ inches. Dimension 2413 is 19 inches.

FIG. 25 depicts an application of the post 2400 that is this invention for woven wire fence. It shows a notch 2503 or notch where the woven wire fence can be attached to the modules with tie-backs.

Regarding FIG. 25, mortar 2501 is applied between modules (such as 2504, 2505, and 2507). A woven wire fence 2502 is 10 ga. A notch 2503 is 1 and ½ inches by ¾ inches. Module 2504 is a standard top wire module. Module 2505 is a standard middle wire module. Tie 2506 is 12.5 gauge galvanized tie, which is used to tie-back the fence 2502 into a notch 2503. Module 2507 is a standard pylon module. Dimension 2508 is 33 and ⅜ inches below ground level. Dimension 2509 is 4 and ⅝ inches. Dimension 2510 is ⅜ inches. Dimension 2511 is 9 inches. Dimension 2512 is ⅜ inches. Dimension 2513 is 19 inches.

FIG. 26 depicts an application of this invention for board rail fence. It shows the drop-in anchors and the socket flat heads that are used to attach the boards to the post.

Regarding FIG. 26, a dimension of board 2601 is 2 inches by 6 inches. Screw 2602 is a ⅜-16 by 2 inch socket flat head screw. Dimension of board 2603 is 2 inches by 4 inches. Mortar 2604 is applied between modules (such as 2606, 2609, 2613). Anchor 2605 is a ⅜ inch by 1 and ⅝ inch anchor that can be dropped into a hole 2610. Module 2606 is a standard middle post module. Rebar 2608 of ⅜ inch by 6 inch dimension is connected to modules (such as 2606, 2609, 2613) with epoxy. Module 2609 is a standard middle fence module. Hole 2610 is a 7/16 inch by 1 and ⅝ inch hole. Hole 2612 is a ½ inch by 3 and 11/16 inches. The hole 2612 receives rebar 2608 and the rebar is connected to the hole 2612 with epoxy. Module 2613 is a standard pylon module.

FIG. 27 shows another view of one of another module 2700 used in the post that is this invention. Regarding FIG. 27, dimension 2701 is 6 inches. Angles 2702 and 2703 are 54 degrees. Dimension 2704 is 5 inches. Dimension 2705 is 2 inches. Hole 2706 is ¾ inches in size, and of 9 inches in length. Dimension 2707 is 2 inches. Dimension 2708 is 2 inches. Dimension 2709 is 6 inches.

FIG. 28 shows another view of the module in FIG. 27 showing the wire cage in the module. Regarding FIG. 28, cage 2801 is 16 ga 1 inch by 1 inch galvanized wire cage.

FIG. 29 shows another posterior view of the module in FIG. 27. Regarding FIG. 29, dimension 2901 is 9 inches. Dimension 2902 is 6 inches.

FIG. 30 shows an interior view of the module of FIG. 27 showing the wire cage. Regarding FIG. 30, Hole 3001 is ¾ inches by 9 inches, and is a hole for rebar (such as 2608, FIG. 26). Cage 3002 is a 16 ga 1 inch by 1 inch wire cage. Hole 3003 is a ¾ inch hole. Midpoint 3004 of the hole 3003 is 3/16 inches from an exterior edge 3005 of the hole 3003.

FIG. 31 is another interior view of the module of FIG. 27. Regarding FIG. 31, holes 3103, 3105, 3106, and 3107 are 3/16 inch holes. A center hole 3108 is a ¾ inch hole. Dimension 3102 from a 3/16 hole (3103, 3105, 3106, and 3107) to an edge 3110 is 1 inch. Distance from 3/16 holes 3103, 3105 to the center hole 3108 is 1 inch. Distance from 3/16 holes 3106 and 3107 to center hole 3111 is 1 inch. The center holes 3108 and 3111 are 2 inches apart. Module 3100 has length 3112 of 9 inches. Notch 3101 has a width of 3 and ¾ inches with length of ¾ inches. Distance 3109 from hole 3105 and hole 3107 to the bottom 3113 of the notch 3101 is 1 inch.

FIG. 32 is a side view of the module of FIG. 27, showing a notch. Regarding FIG. 32, Dimension 3201 is 6 inches. Dimension 3202 is 6 inches. Notch dimension 3204 is 3 and ¾ inches. Notch dimension 3203 is ¾ inches. As an example, a 2 inch by 4 inch board can rest in the notch 3205.

FIG. 33 is a side view of the module of FIG. 27 showing concrete fasteners inserted in the module. Regarding FIG. 33, A first concrete fasteners 3312 and a second concrete fastener 3301 are seen inserted into a module 3308. The fasteners 3301, 3312 are 3 and ¾ inch by ¼ inch phillips head concrete fasteners. The concrete fasteners 3301, 3312 are at a depth 3302 of 2 and ¼ inches into the concrete module 3308 if the fasteners are connected to a 2 inch by 4 inch fence board. The first concrete fastener 3312 is at a distance 3307 of 3 and ¼ inches below a top 3309 of the module. The second concrete fastener 3301 is a distance 3306 of 1 inch below the first concrete fastener 3312. A notch 3310 is in the module 3308, with a width 3303 of ¾ inches and a height 3311 of 3 and ¼ inches. The second concrete fastener 3301 is a distance 3305 of 1 inch above the bottom 3310 of the notch 3308. The fasteners 3301, 3312 jut out a distance 3304 of ¾ inches out of the module 3308.

FIG. 34 is a side view of the module of FIG. 27, showing holes for the concrete fasteners. Regarding FIG. 34, the module 3414 is shown with holes 3409, 3410, 3407, and 3408. The holes (3409, 3410, 3407, and 3408) are 3/16 inch holes, with depth of 2 and ¼ inch depth. The holes 3409 and 3410 are a distance 3412 of 1 inch from an edge 3415 of the module 3414. The holes 3409 and 3410 are a distance 3411 of 1 inch from each other. The hole 3410 is a distance 3413 of 1 inches from a bottom 3401 of the notch 3415. The bottom 3401 of the notch 3415 can support a 2 inch by 4 inch board 3405.

FIG. 35 is an interior view of an embodiment of the post that is this invention 3500, showing the wire cage and rebar. Regarding FIG. 35, the post 100 is shown with eight modules (top module not shown) (3501, 3502, 3503, 3504, 3505, 3506, 3507, and 3508) on top of a base module 3509. Two ⅜ inch rebar 3510 and 3511 are shown from the top module 3508 into the base module 3509. The rebar 3510 is placed into the ¾ inch hole 3512. The rebar 3511 is placed into the ¾ inch hole 3513. A top inch 3514 of the top module 3508 is composed of anchoring cement and seals the rebar 3510 and 3511 from weather. Each module (3501, 3502, 3503, 3504, 3505, 3506, 3507, and 3508) has a bead of transparent waterproof silicone between the module and an adjoining module ensure sealing between the modules from weather. The rebar 3510 and 3511 can be sealed by anchoring cement 2 hours at 2000 psi, and 30 days at 7000 psi, with the anchoring cement poured into both holes 3512, 3513. The total height of the post 100 is 80 inches, with the base module 3509 18 inches in height and the other eight modules module (3501, 3502, 3503, 3504, 3505, 3506, 3507, and 3508) 9 inches in height.

FIG. 36 is a side view of the post 3500 (FIG. 35) connected to fencing. Regarding FIG. 36, shown are 2 inch by 4 inch boards (3601, 3602, 3603) attached to the post 100 with cedar fencing boards (3604 and 3605).

The invention claimed is:

1. A stackable concrete post comprising:

a concrete pylon base, wherein the concrete pylon base has two tapered edges from top to bottom, with the bottom of the concrete pylon base wider than the top of the concrete pylon base, wherein the concrete pylon base has two tapered edges from one side of the top of the concrete pylon base to another side of the top of the concrete pylon base;

wherein the concrete pylon base has a top surface end that is completely flat to allow mating of vertical stacking of multiple concrete modules to the completely flat top surface of the concrete pylon base;

wherein the concrete pylon base has a galvanized wire cage within the concrete pylon base, wherein the galvanized wire cage within the concrete pylon base is made of 16 gauge wire and is a one inch by one inch galvanized wire cage;

multiple concrete modules comprised of cement that are stacked vertically onto the concrete pylon base, wherein the multiple concrete modules include exactly two ¾ inch diameter by 9 inch length holes within each of the multiple concrete modules for rebar, wherein each of the exactly two ¾ inch diameter by 9 inch length holes are vertical holes;

wherein each of the exactly two ¾ inch diameter by 9 inch length holes are two inches from each other and 2½ inches from a side of each of the multiple concrete modules;

wherein each of the multiple concrete modules, other than the concrete pylon base, are of equal size;

a single rebar inserted within each of the exactly two ¾ inch diameter by 9 inch length holes within each of the multiple concrete modules, wherein each of the single rebar extends from a top one of the multiple concrete modules into the concrete pylon base;

anchoring cement inserted within the ¾ inch diameter by 9 inch length holes within each of the multiple concrete modules;

waterproof silicone inserted between one of the multiple concrete modules and another one of the multiple concrete modules;

wherein the multiple concrete modules are reinforced with a galvanized wire cage inside each of the multiple concrete modules, wherein the galvanized wire cage inside each of the multiple concrete modules is a 16 gauge one inch by one inch wire cage, wherein there is vertical stacking of modules on the concrete pylon base, wherein a top end and a bottom end of each of the multiple concrete modules is completely flat;

wherein each of the multiple concrete modules has tapered edges on exactly two edges of the multiple concrete modules, wherein each of the tapered edges of the multiple concrete modules is one inch wide and is tapered at a 54 degree angle on a backside of each of the multiple concrete modules;

wherein each of the multiple concrete modules include a notch for board fencing, wherein each of the multiple concrete modules include exactly four horizontal holes that are located within an area of the notch on a front side of each of the multiple concrete modules configured to attach lumber with concrete fasteners; and wherein the notch on the front side of each of the multiple concrete modules extends upwardly to a top of each of the multiple concrete modules.

2. A method of constructing a stackable concrete post comprising:

placing a concrete pylon base directly into a hole in earth, and securing the concrete pylon base in the hole with earth fill;

wherein the concrete pylon base has two tapered edges from top to bottom, with the bottom of the concrete pylon base wider than the top of the concrete pylon base, wherein the concrete pylon base has two tapered edges from one side of the top of the concrete pylon base to another side of the top of the concrete pylon base;

wherein the concrete pylon base has a galvanized wire cage within the concrete pylon base, wherein the galvanized wire cage within the concrete pylon base is made of 16 gauge wire and is a one inch by one inch galvanized wire cage;

stacking vertically multiple concrete modules on top of the concrete pylon base;

wherein the concrete pylon base is placed into the hole in the earth with a first module stacked vertically on top of the concrete pylon base in the hole in the earth secured together with two ⅜ inch rebars in two ¾ inch diameter holes filled by anchoring cement;

wherein the multiple concrete modules include exactly two ¾ inch diameter by 9 inch length holes within each of the multiple concrete modules for rebar;

placing a single rebar inserted within each of the two ¾ inch diameter by 9 inch length holes within each of the multiple concrete modules, wherein each of the single rebar extends from a top one of the multiple concrete modules into the concrete pylon base;

wherein each of the exactly two ¾ inch diameter by 9 inch length holes are vertical holes;

wherein each of the exactly two ¾ inch diameter by 9 inch length holes are two inches from each other and 2½ inches from a side of each of the multiple concrete modules;

wherein each of the multiple concrete modules, other than the concrete pylon base, are of equal size;

placing anchoring cement within the ¾ inch diameter by 9 inch length holes within each of the multiple concrete modules;

placing waterproof silicone between one of the multiple concrete modules and another one of the multiple concrete modules;

wherein the multiple concrete modules are reinforced with a galvanized wire cage inside each of the multiple concrete modules;

wherein the galvanized wire cage inside each of the multiple concrete modules is a 16 gauge one inch by one inch wire cage, wherein each of the multiple concrete modules has tapered edges on exactly two edges of the multiple concrete modules, wherein each of the tapered edges of the multiple concrete modules is one inch wide and is tapered at a 54 degree angle on a backside of each of the multiple concrete modules;

wherein each of the multiple concrete modules include a notch for board fencing;

wherein each of the multiple concrete modules include exactly four horizontal holes that are located within an area of the notch; and wherein the notch extends upwardly to a top of each of the multiple concrete modules; and connecting the multiple concrete modules to board fencing with drop-in anchors and concrete fasteners.

* * * * *